US007304623B2

(12) United States Patent
Tomizawa et al.

(10) Patent No.: US 7,304,623 B2
(45) Date of Patent: Dec. 4, 2007

(54) VIDEO SIGNAL PROCESSING CIRCUIT, VIDEO SIGNAL PROCESSING METHOD, VIDEO SIGNAL PROCESSING PROGRAM, AND COMPUTER-READABLE STORAGE MEDIUM

(75) Inventors: Kazunari Tomizawa, Kyoto (JP); Yoshihiro Okada, Kyoto (JP); Atsushi Ban, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 207 days.

(21) Appl. No.: 11/123,172

(22) Filed: May 6, 2005

(65) Prior Publication Data

US 2005/0248595 A1 Nov. 10, 2005

(30) Foreign Application Priority Data

May 10, 2004 (JP) ..... 2004-140309

(51) Int. Cl.
*G09G 3/36* (2006.01)

(52) U.S. Cl. ..... 345/88; 345/690

(58) Field of Classification Search ..... None
See application file for complete search history.

(56) References Cited

U.S. PATENT DOCUMENTS 5,461,503 A 10/1995 Deffontaines et al.
2002/0033809 A1 3/2002 Nakajima
2004/0174389 A1* 9/2004 Ben-David et al. ..... 345/694

FOREIGN PATENT DOCUMENTS

| | | |
|---|---|---|
| JP | 62-118325 | 5/1987 |
| JP | 03-021189 | 1/1991 |
| JP | 03-078790 | 4/1991 |

* cited by examiner

*Primary Examiner*—Mark Zimmerman
*Assistant Examiner*—Kevin Xu
(74) *Attorney, Agent, or Firm*—Harness, Dickey & Pierce, P.L.C.

(57) ABSTRACT

With regard to each of primary colors for image display on the image display panel, (i) three video signals are extracted from each of video signal rows of J types in which the video signals supplied to pixels are aligned in line with time series, in such a manner as to cause the order of primary colors reproduced by the three video signals to be in line with the order of the J primary colors allocated to the respective pixels, and (ii) video signal rows of three types are generated by serially allocating each of the three video signals to any one of the video signal rows of three types.

9 Claims, 14 Drawing Sheets

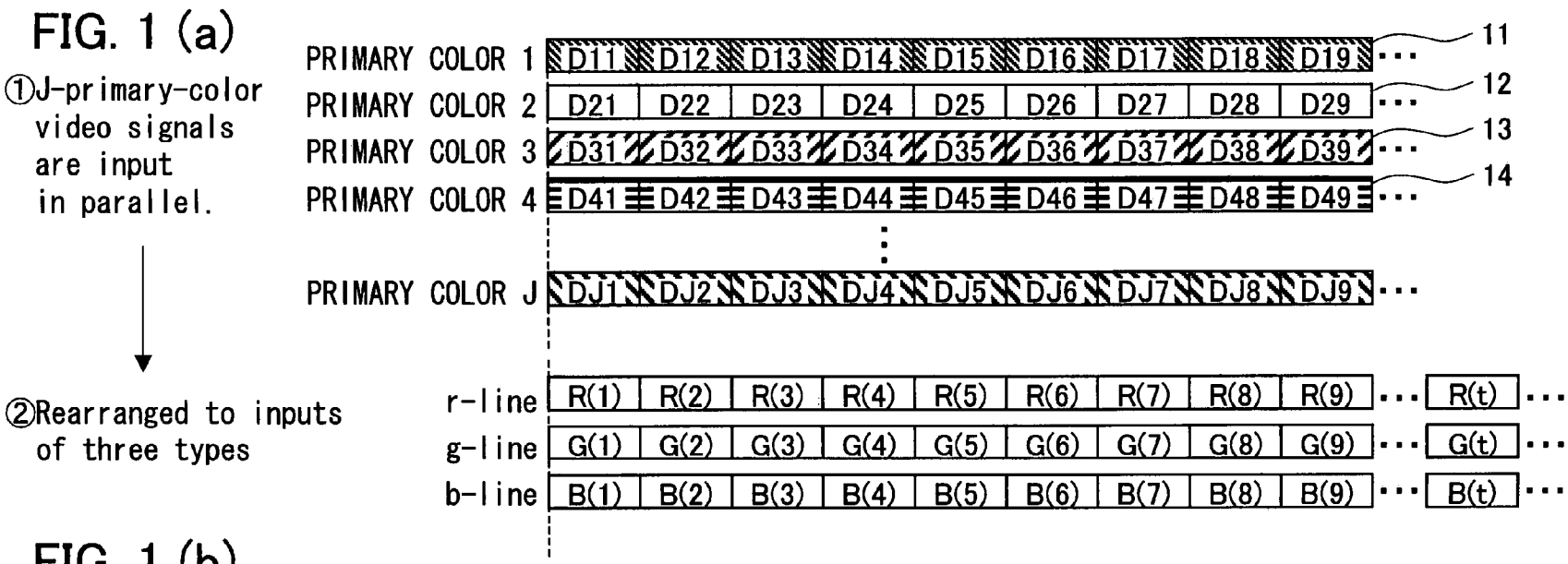
FIG. 1 (a)
①J-primary-color video signals are input in parallel.
②Rearranged to inputs of three types
PRIMARY COLOR 1
PRIMARY COLOR 2
PRIMARY COLOR 3
PRIMARY COLOR 4
PRIMARY COLOR J
r-line
g-line
b-line
D11 D12 D13 D14 D15 D16 D17 D18 D19
D21 D22 D23 D24 D25 D26 D27 D28 D29
D31 D32 D33 D34 D35 D36 D37 D38 D39
D41 D42 D43 D44 D45 D46 D47 D48 D49
DJ1 DJ2 DJ3 DJ4 DJ5 DJ6 DJ7 DJ8 DJ9
R(1) R(2) R(3) R(4) R(5) R(6) R(7) R(8) R(9) R(t)
G(1) G(2) G(3) G(4) G(5) G(6) G(7) G(8) G(9) G(t)
B(1) B(2) B(3) B(4) B(5) B(6) B(7) B(8) B(9) B(t)
11
12
13
14

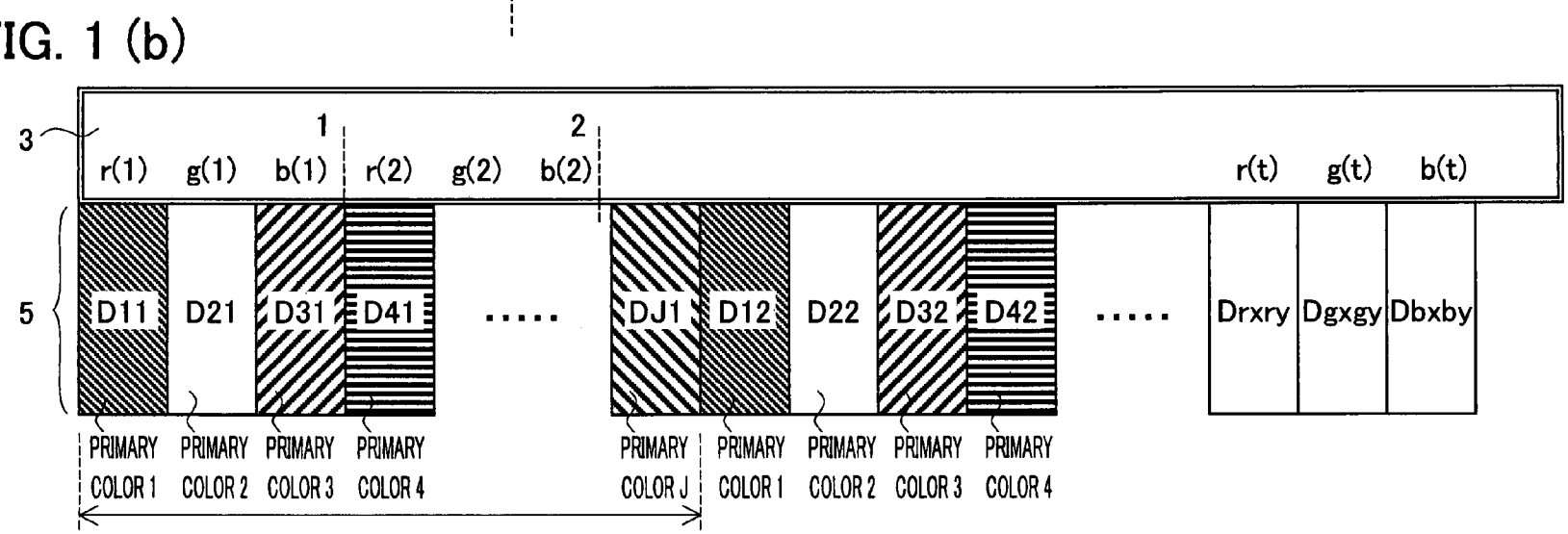
FIG. 1 (b)
r(1) g(1) b(1) r(2) g(2) b(2) r(t) g(t) b(t)
D11 D21 D31 D41 D12 D22 D32 D42 DJ1
Drxry Dgxgy Dbxby
PRIMARY COLOR 1
PRIMARY COLOR 2
PRIMARY COLOR 3
PRIMARY COLOR 4
PRIMARY COLOR J
1
2
3
5

①Five-primary -color video signals are input in parallel.

↓

②Importance is attached to fourth and fifth primary colors, so that these primary colors are converted into primary color 4.

↓

③Rearranged to inputs of three types

VIDEO SIGNAL PROCESSING CIRCUIT, VIDEO SIGNAL PROCESSING METHOD, VIDEO SIGNAL PROCESSING PROGRAM, AND COMPUTER-READABLE STORAGE MEDIUM

This Nonprovisional application claims priority under 35 U.S.C. § 119(a) on Patent Application No. 2004-140309 filed in Japan on May 10, 2004, the entire contents of which are hereby incorporated by reference.

FIELD OF THE INVENTION

The present invention relates to a video signal processing circuit for display with color video signals, and particularly to processing of video signals supplied to an image display device that reproduces color images using more than three primary colors.

BACKGROUND OF THE INVENTION

Image display devices such as color TVs and color monitors typically reproduce colors by performing additive color mixing of RGB primary colors. Such image display devices include a matrix-driven image display device (see, for instance, Japanese Laid-Open Patent Application No. 3-78790/1991; published on Apr. 3, 1991).

First, matrix driving will be described in reference to FIG. 10. The matrix-type structure is broadly used in liquid crystal image display devices, EL image display devices, PDP (Plasma Display Panel) image display devices, and the like. It is, however, noted that components of an image display device may be differently named in another type of image display device. In the present application, names of components used in describing the structure of a matrix image display device conform to those of a liquid crystal panel.

As shown in FIG. 10, a matrix image display panel is provided with (i) source bus lines 100 that are vertically provided and in parallel to each other and (ii) gate bus lines 200 that are perpendicular to the respective source bus lines 100.

The source bus lines 100 are connected, at an edge of the image display panel, to a source driver 300. From this source driver 300, video input signals are transmitted to respective pixels. The gate bus lines 200 are connected, at an edge of the image display panel, to a gate driver 400.

The source driver 300 stores video input signals supplied to the respective source lines, and writes the video signals into the gate bus lines 200 that are turned on by the gate driver 400. The gate driver 400 turns on the gate bus lines 200 one by one, so that images are displayed on the entirety of the image display panel.

For color image reproduction, the source bus lines 100 are typically connected to orderly-arrayed R-color, G-color, and B-color pixels, and also to the source driver 300. The source driver 300 supports color image reproduction, so that input lines r-line, g-line, and b-line, which correspond to R, G, and B, receive R, G, and B color video signals, respectively.

FIG. 11 shows video signals supplied to the source driver 300. As in this figure, video input signals are arranged in such a manner that, corresponding to the input lines r-line, g-line, and b-line of the source driver 300, video signals R supplied to R-color pixels, video signals G supplied to G-color pixels, and video signals B supplied to B-color pixels are successively provided in line with time series.

The video signal R(i) (i is an integer) is a video signal supplied to an i-th R-color pixel that is counted in the direction that the gate bus lines are aligned and counted from an R-color pixel firstly turned on. In a similar manner, the video signal G(i) is a video signal supplied to an i-th G-color pixel that is counted in the direction that the gate bus lines are aligned and counted from a G-color pixel firstly turned on, and the video signal B(i) is a video signal supplied to an i-th B-color pixel that is counted in the direction that the gate bus lines are aligned and counted from an B-color pixel firstly turned on.

Each output terminal of the source driver 300 one-to-one corresponds to a group of source bus lines 100 for R, G, or B color, and this allows the image display panel to reproduce color images.

Some source drivers for color display have two inputs to each of R, G, and B color groups. In such a source driver, RGB video input signals supplied to odd lines are separated from RGB video input signals supplied to even lines.

That is, the video input signals shown in FIG. 11 are separated into (i) odd-line video input signals made up of video signals R(2n−1), G(2n−1), and B(2n−1) and (ii) even-line video input signals made up of video signals R(2n), G(2n), and B(2n), as shown in FIG. 12 (n is an integer). As FIG. 13 illustrates, the video input signals thus separated are supplied to odd source bus lines 100 and even source bus lines 100.

When the video input signals are supplied from the source driver 300 as above, the RGB signals are simply separated into odd-line signals and even-line signals, at the stage of input to the source driver 300. On this account, such a driver that separate the video signals and input the same to the pixels is also regarded as a driver having three types of input terminals.

In the meanwhile, an image display device that reproduces images using not less than four primary colors (RGB primary colors and at least one other primary color) has been proposed. Such an image display device adopting not less than four primary colors can set, on a CIE chromaticity diagram, a color reproduction range outside of the reproduction range of the RGB primary colors, so that the color reproduction range of this image display device is wider than that of an image display device adopting RGB primary colors.

The image display device adopting not less than four primary colors has typically adopted a dedicated source driver which has not less than four input types corresponding to not less than four primary colors.

As shown in FIG. 14, to perform image reproduction with multiple primary colors on a J-primary-color (J is an integer not less than 4) image display panel 500, a timing controller 600 that controls a source driver 510 and a gate driver 520 receives video signals (J-primary-color video signals) of J types. On this account, the source driver 510 is a source driver that is dedicated to multiple primary color display and has J input types.

However, such a dedicated source driver having not less than four input types is not in widespread use. A typical source driver has RGB (three) input types. On this account, adopting the source driver dedicated to multiple primary colors increases the manufacturing costs of the image display device.

SUMMARY OF THE INVENTION

The present invention was done to solve the above-described problem. The objective of the present invention is therefore to provide a video signal processing circuit that realizes, with low costs, an image display device capable of displaying images using multiple primary colors, a video signal processing method, a video signal processing program, and a computer-readable storage medium.

To solve the above-described problem, a video signal processing circuit, which converts video signals supplied to pixels disposed in a matrix manner on an image display panel, is characterized in that, with regard to each of J (J is an integer not less than four) primary colors for image display on the image display panel, (i) three video signals are extracted from each of video signal rows of J types in which the video signals are aligned in line with time series, in such a manner as to cause an order of primary colors reproduced by the three video signals to be in line with an order of the J primary colors allocated to the respective pixels, and (ii) video signal rows of three types are generated by serially allocating each of the three video signals to any one of the video signal rows of three types.

Also, to solve the above-described problem, a video signal processing method, by which video signals supplied to pixels provided in a matrix manner on an image display panel are converted, is characterized by comprising the steps of: (i) with regard to each of J (J is an integer not less than four) primary colors for image display on the image display panel, extracting, from each of video signal rows of J types in which the video signals are aligned in line with time series, three video signals in such a manner as to cause an order of primary colors reproduced by the three video signals to be in line with an order of the J primary colors allocated to the respective pixels, and (ii) generating video signal rows of three types by serially allocating each of the three video signals to any one of the video signal rows of three types.

In the image display panel on which the pixels are provided in a matrix manner, image reproduction is carried out by performing matrix-driving of the pixels using the source driver and the gate driver.

However, in a case where the image display panel reproduces images using not less than four primary colors, one of the not less than four primary colors is allocated to each pixel. When a source driver whose number of input/output types is identical with the number of primary colors used for image reproduction is adopted to the aforesaid image display panel that reproduces images using multiple primary colors, the manufacturing costs of an image display device including the image display panel are high, because the aforesaid source driver is not in general use.

Taking this problem into account, the video signal processing circuit and the video signal processing method of the present invention are arranged in such a manner that, three video signals are extracted from video signal rows of J types in which the video signals are aligned in line with time series, in such a manner as to cause an order of primary colors reproduced by the three video signals to be in line with an order of the J primary colors allocated to the respective pixels. Then, in the present invention, video signal rows of three types are generated by serially allocating each of the three video signals to any one of the video signal rows of three types. With this, the order of the primary colors reproduced by the extracted three video signals is not disturbed. In other words, the video signal rows of three types generated by the video signal processing circuit of the present invention include the video signals aligned in the order corresponding to the order of the J primary colors on the image display panel.

On this account, the video signals are outputted in the order corresponding to the order of the J primary colors on the image display panel, by outputting, to the source driver with three input/output types, the video signal rows of three types supplied in accordance with the video signal processing circuit and the video signal processing method of the present invention. Therefore, the video signal rows of three types supplied from the video signal processing circuit of the present invention are serially outputted from the source driver with three input/output types, so that the video signals are outputted in the order corresponding to the order of the J primary colors on the image display panel. In short, the video signal processing circuit and the video signal processing method of the present invention allow for image reproduction with J primary colors, using a source driver having three input/output types.

Such a source driver having three input/output types is in general use, e.g. used in typical liquid crystal image display panels that reproduce images using RGB colors. On this account, the video signal processing circuit and the video signal processing method of the present invention allow for image reproduction with J primary colors, using a general-use source driver, so that the manufacturing costs for the image display device are saved.

For a fuller understanding of the nature and advantages of the invention, reference should be made to the ensuing detailed description taken in conjunction with the accompanying drawings.

BRIEF DESCRIPTION OF THE DRAWINGS

FIG. 1(*a*) illustrates video signals for reproducing J primary colors, and video signal rows in which the video signals are classified into three types. FIG. 1(*b*) shows how a J-primary-color image display panel is connected to a source driver.

FIG. 3(*b*) shows how a five-primary-color image display panel is connected to the source driver.

FIG. 4(*b*) illustrates how a five-primary-color image display panel is connected to the source driver.

FIG. 5(*b*) illustrates how the five-primary-color image display panel and the source driver of the FIG. 5(*a*) are connected to each other.

DESCRIPTION OF THE EMBODIMENTS

[1. Structure of Image Display Device]

Figure 2:
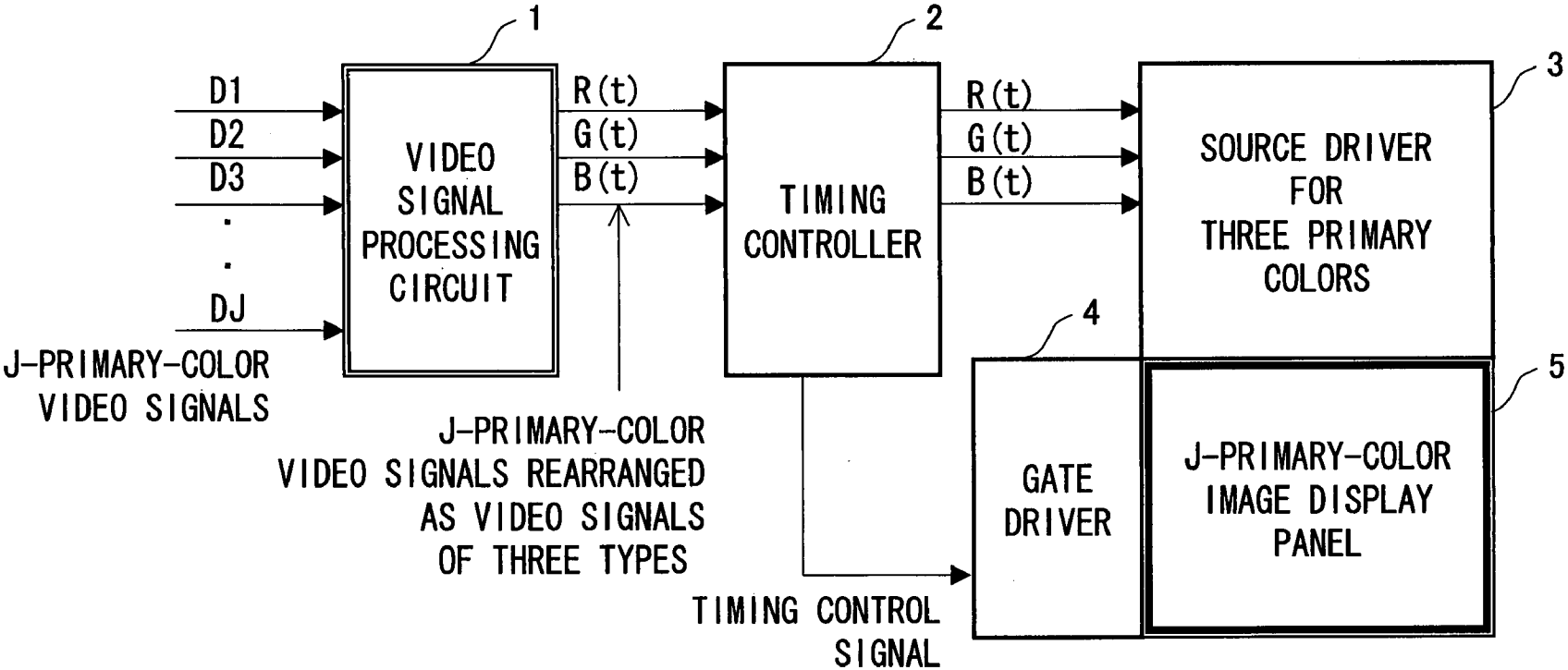
FIG. 2 is a block diagram showing an image display device adopting a video signal processing circuit of the present invention.

An embodiment of a signal processing circuit of the present invention will be described in reference to attached figures. As shown in FIG. 2, an image display device adopting a video signal processing circuit 1 of the present embodiment includes the video signal processing circuit 1, a timing controller 2, a three-primary-color source driver 3, a gate driver 4, and a J-primary-color image display panel 5 in which each pixel is assigned to one of J primary colors.

By a below-mentioned scheme, the video signal processing circuit 1 converts video signals (J-primary-color video signals) D1, D2, D3, . . . , DJ, which are supplied to the video signal processing circuit 1 and separated into J types, into video signals R(t), G(t), and B(t) of three (R, G, and B) types (t is an integer). These video signals R(t), G(t), and B(t) of the RGB types are supplied to the timing controller 2. The video signal processing circuit 1 may convert the J-primary-color video signals into video signals of three (CMY) types.

The timing controller 2 outputs the video signals R(t), G(t), and B(t) to the three-primary-color source driver 3. In the meanwhile, the timing controller 2 outputs a timing control signal to the gate driver 4. This timing control signal is used for serially selecting the gate bus lines (not illustrated) inside the J-primary-color image display panel 5 so as to turn these gate bus lines on.

The source driver 3 serially writes the video signals R(t), G(t), and B(t) into the source bus lines (not illustrated) connected to the gate bus line selected by the gate driver 4. The gate driver 4 serially selects, in accordance with the timing control signal, the gate bus lines inside the J-primary-color image display panel 5, so as to turn these gate bus lines on.

Figure 10:
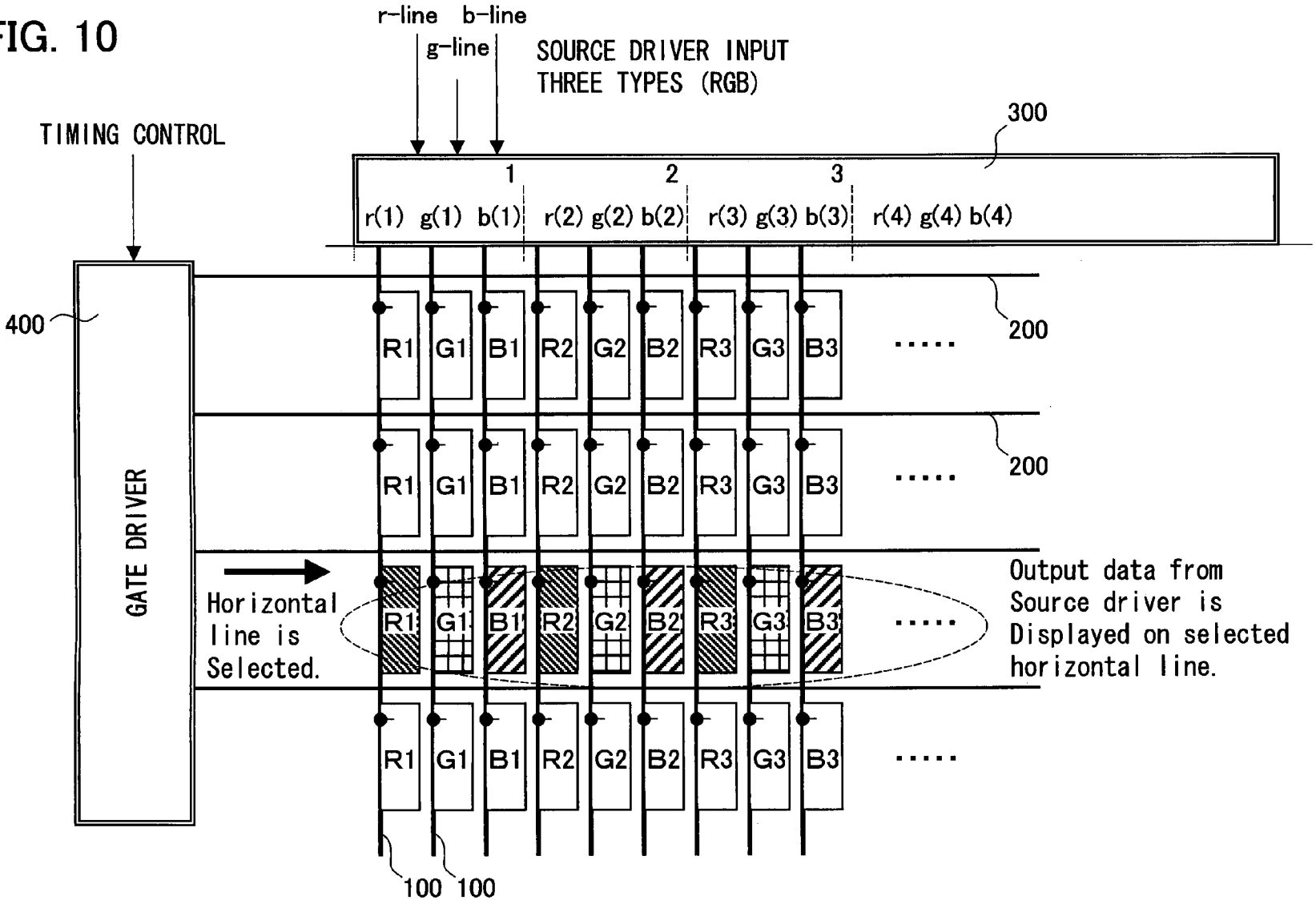
FIG. 10 shows how an image display panel that displays images using RGB colors are connected to a source driver and a gate driver.
Figure 11:
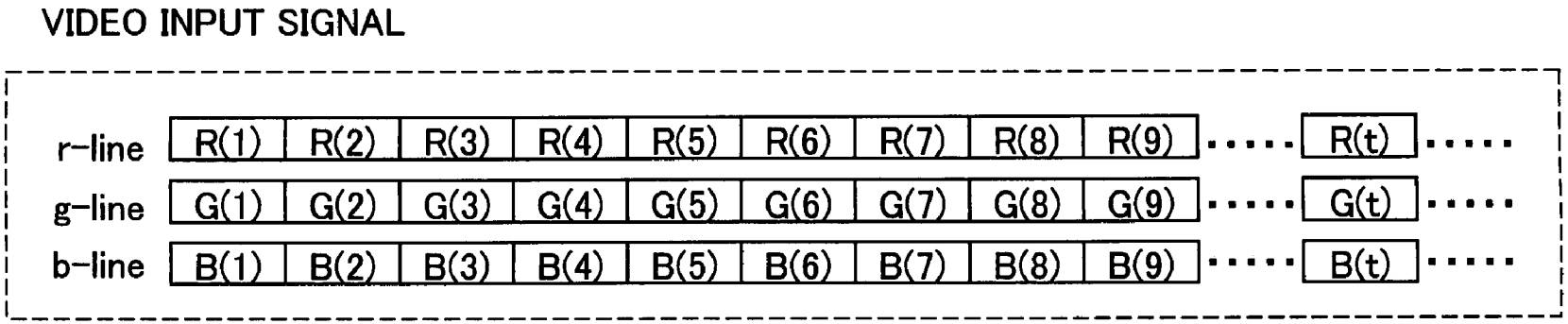
FIG. 11 shows video signals for displaying images by RGB colors.
Figure 12:
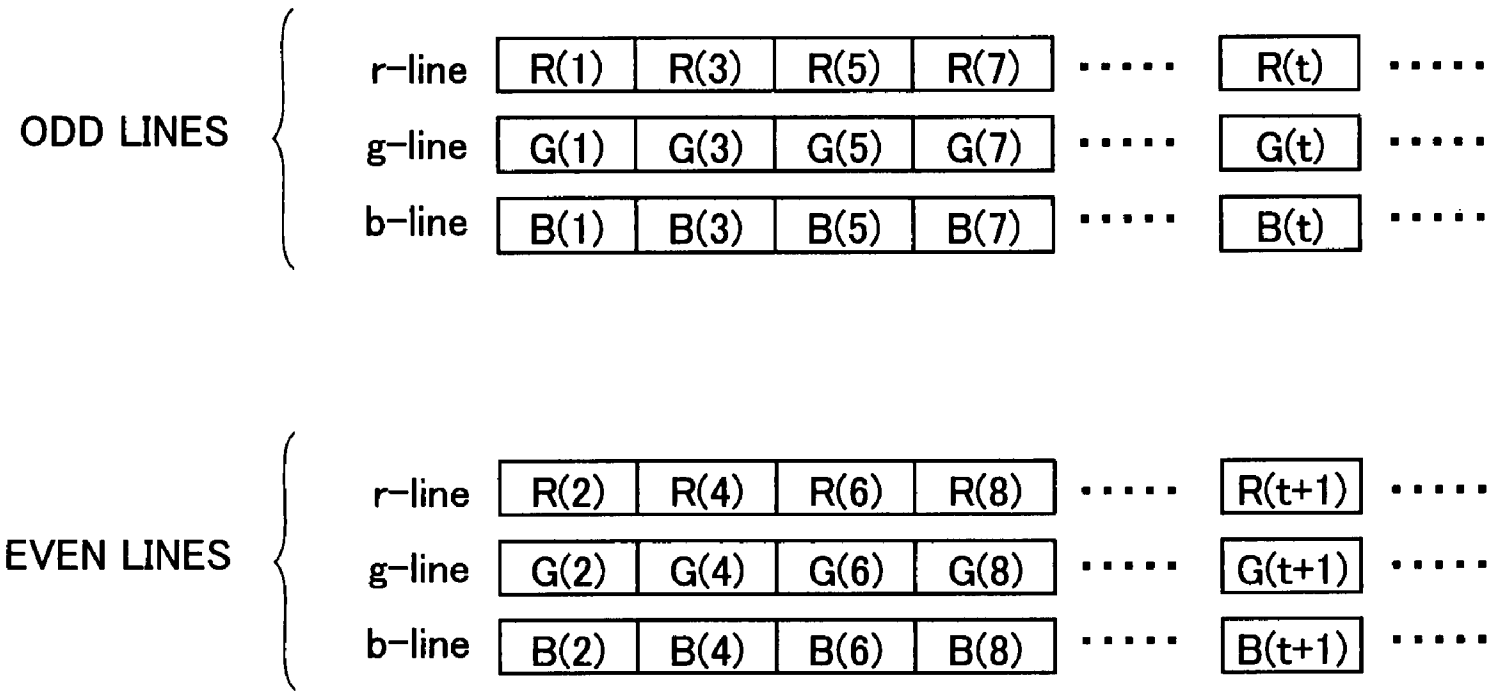
FIG. 12 illustrates that the video signals of FIG. 11 are separated into video signals of odd lines and video signals of even lines.

The J-primary-color image display panel 5 is arranged such that the gate bus lines and the source bus lines are provided orthogonal to each other. The J-primary-color image display panel 5 is basically identical with the matrix image display panel that was described above in reference to FIG. 10. However, the difference between the image display panel shown in FIG. 10 and the image display panel shown in FIG. 2 lies in a point that, in the image display panel in FIG. 10, a pixel at the junction of the gate bus line and the source bus line has one of R, G, and B colors, while, in the J-primary-color image display panel 5 shown in FIG. 2, each pixel has one of J primary colors.

On account of the arrangement above, the image display device of the present embodiment converts, using the video signal processing circuit 1, the J-primary-color video signals into the video signals of three types, and outputs the converted video signals of the three types to the J-primary-color display panel 5, using the source driver 3. As a result, the image display device of the present embodiment displays images using J primary colors. The characteristic feature of the image display device of the present embodiment lies in a point that the video signal processing circuit 1 that converts J-primary-color video signals into video signals of three types is adopted. The following specifically describes this conversion of the video signals.

[2. Example of Video Signal Conversion]

The following will describe an example of conversion of video signals performed by the video signal processing circuit 1. First, as shown in FIG. 1(*a*), the J-primary-color video signals include a signal row 11 for displaying primary color 1, a signal row 12 for displaying primary color 2, a signal row 13 for displaying primary color 3, and a signal row 14 for displaying primary color 4. In this manner, the J-primary-color video signals are made up of signal rows for displaying J primary colors.

More specifically, the signal row 11 is arranged such that video signals D11, D12, D13, D14 and so on are aligned in line with time series. In a similar manner, the signal row 12 is arranged such that video signals D21, D22, D23, D24 and so on are aligned in line with time series, and the signal row 13 is arranged such that video signals D31, D32, D33, D34, and so on are aligned in line with time series. Also, a signal row for displaying primary color J is arranged such that video signals DJ1, DJ2, DJ3, and so on are aligned in line with time series.

For example, provided that the primary color 1 is red, the video signal D11 is supplied to a red pixel that is primarily turned on in the J-primary-color image display panel 5. In a similar manner, the video signal D12 is supplied to a red pixel that is secondly turned on in the J-primary-color image display panel 5. In the meanwhile, provided that the primary color 2 is yellow, the video signal D21 is supplied to an yellow pixel that is primarily turned on in the J-primary-color image display panel 5.

FIG. 1(*b*) shows how the three-primary-color source driver 3 is connected to the J-primary-color image display panel 5. It is noted that FIG. 1(*b*) only shows pixels connected to one gate bus line in the image display panel 5, for the sake of simplicity.

As shown in FIG. 1(*b*), when the J-primary-color image display panel 5 is simply connected to the three-primary-color source driver 3, the number of primary colors of the panel is larger than the number of output types of the source driver 3, so that the output types of the source driver 3 are not matched with the primary colors of the image display panel 5.

Figure 13:
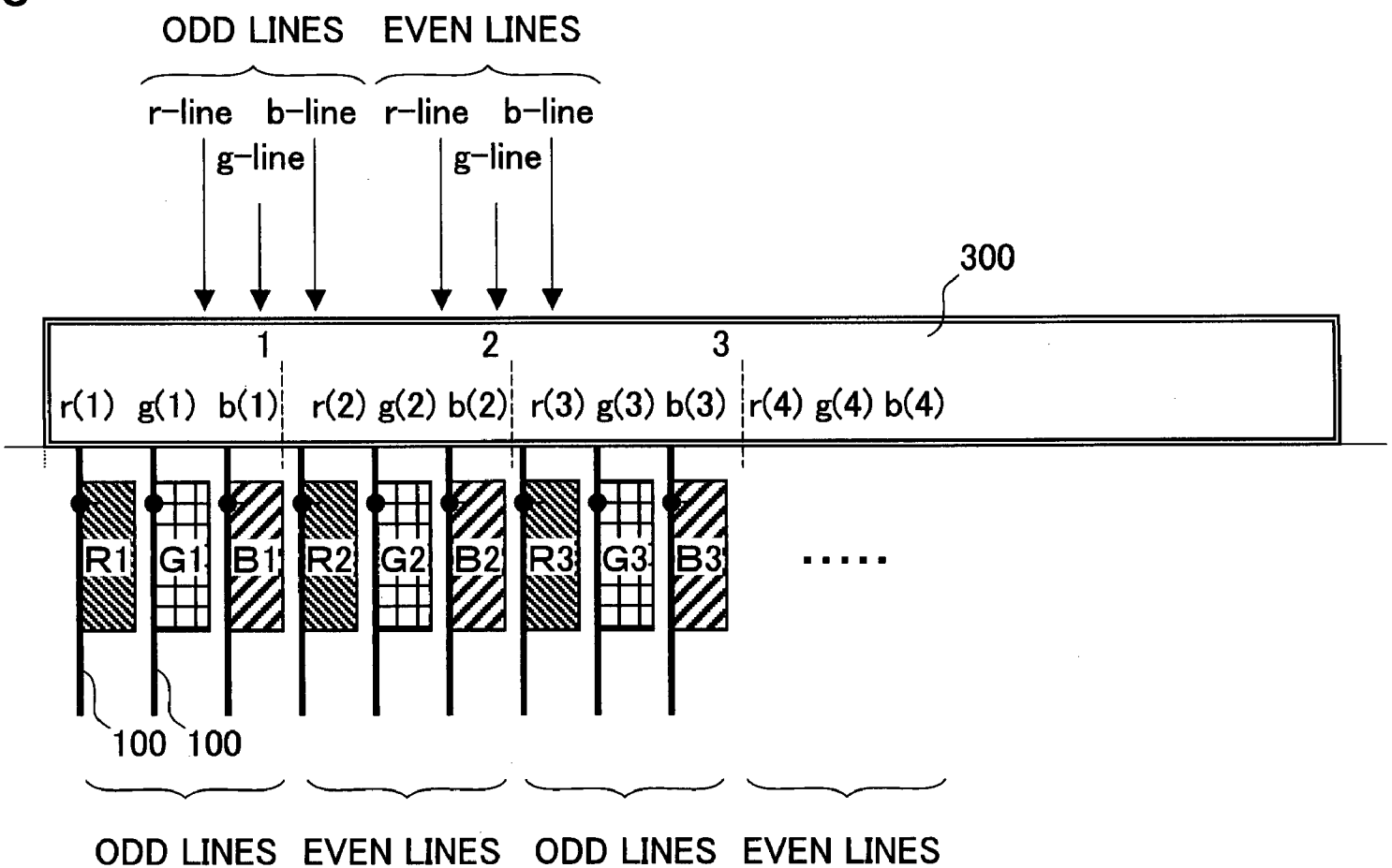
FIG. 13 shows in what manner the video signals of FIG. 12 are supplied to odd source bus lines and even source bus lines.
Figure 14:
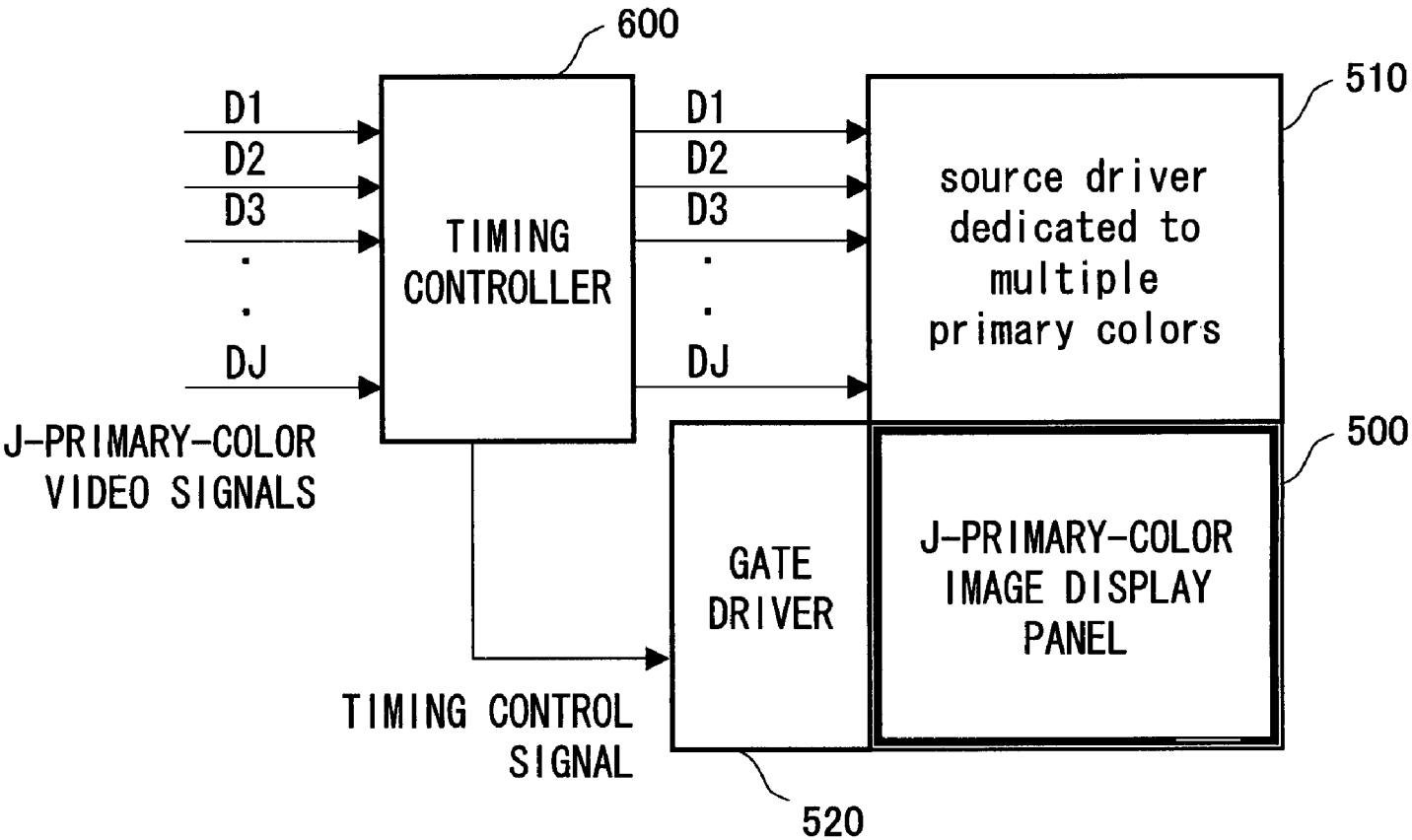
FIG. 14 is a block diagram showing an arrangement for displaying images on a J-primary-color image display panel, using a multiple-primary-color source driver.

That is, as shown in FIG. 13, in a case where an image display device adopts a three-primary-color image display panel, the output terminals r(1), r(2) and so on of the source driver 300 always correspond to respective (red) pixels of the primary color 1. On the contrary, in a case where the multiple-primary-color image display panel 5 is adopted, the output terminals of one type in the source driver 3 do not always correspond to the pixels of one color, as shown in FIG. 1(*b*). Note that, "one type" indicates a type of output terminals corresponding to one primary color, when the output terminals of the source driver 3 are classified into three primary colors.

For example, From the output terminal r(1) of the source driver 3, the video signal D11 is outputted. This indicates that the output terminal r(1) of the source driver 3 corresponds to the primary color 1. In the meanwhile, the output terminal r(2) that belongs to the same type as the output terminal r(1) outputs the video signal D41. This indicates that the output terminal r(2) of the source driver 3 corresponds to the primary color 4.

In this manner, although the output terminals r(1) and r(2) belong to the same type, these output terminals correspond to different primary colors.

For this reason, it is necessary to rearrange the J-primary-color video signals as below, in order to cause, at the stage of input to the source driver 3, the primary colors of the respective pixels of the image display panel 5 to one-to-one correspond to the primary colors reproduced by the video signals supplied from the source driver 3.

That is, as shown in FIG. 2, the J-primary-color video signals D1, D2, . . . , DJ are rearranged as the video signals R(t), G(t) and B(t) of three types, using the video signal processing circuit 1, and these video signals R(t), G(t) and B(t), which are thus rearranged, are supplied to the timing controller 2 whose video signal input types correspond to three primary colors. More specifically, the J-primary-color video signals D1, D2, . . . , DJ are rearranged, using the video signal processing circuit 1, in order to cause the order of primary colors reproduced by the video signals R(t), G(t) and B(t), which are supplied from the timing controller 2 to the image display panel 5 via the source driver 3, to be matched with the order of the primary colors of the respective pixels on the image display panel 5. It is noted that the video signals of three types, which are rearranged by the video signal processing circuit 1, may be directly supplied to the source driver 3.

That is to say, the output terminals r(t), g(t), and b(t) of the source driver 3 shown in FIG. 1(*b*) output video signals R(t), G(t), and B(t), respectively. On this account, according to the video signals supplied from the source driver 3 to the image display panel 5, the color reproduction is performed in the order of the video signals R(1), G(1), B(1), R(2), G(2), B(2), and so forth. The J-primary-color video signals D1, D2, . . . , DJ are rearranged using the video signal processing circuit 1, in such a manner as to cause the aforesaid order of color display to be matched with the order of primary colors of the respective pixels of the image display panel 5, i.e. the order of primary color 1, primary color 2, primary color 3, . . . , primary color J.

In other words, as shown in FIG. 1(*b*), in the image display panel 5, the video signals for displaying colors identical with the primary colors of the respective pixels are outputted from the output terminals r(1), g(1), b(1), r(2), and so on of the source driver 3. The relationship between the video signals and the primary colors are arranged such that, the video signal D11 of the primary color 1 corresponds to the pixel of the primary color 1, the video signal D21 of the primary color 2 corresponds to the pixel of the primary color 2, the video signal D31 of the primary color 3 corresponds to the pixel of the primary color 3, the video signal D41 of the primary color 4 corresponds to the pixel of the primary color 4, and so forth.

This conversion of the J-primary-color video signals into the video signals of three types by the video signal processing circuit 1 may be described by the following formula.

As FIG. 1(*a*) illustrates, the J-primary-color video signals (J is an integer not less than 4) are represented by signal rows made up of video signals D11, 12, . . . , D21, D22, . . . , DJ1, DJ2, and on, which are aligned in line with time series. Meanwhile, the video signals of three types are represented by signal rows made up of video signals R(t), G(t), and B(t) (t is an integer). Using the following formula, the J-primary-color video signals are converted to the video signals of three types.

$$R(t)=Drxry$$

$$G(t)=Dgxgy$$

$$B(t)=Dbxby$$

$$rx=\{3(t-1)+1\}-J\cdot Int[\{3(t-1)\}/J]$$

$$ry=Int[\{3(t-1)\}/J]+1$$

$$gx=\{3(t-1)+2\}-J\cdot Int[\{3(t-1)+1\}/J]$$

$$gy=Int[\{3(t-1)+1\}/J]+1$$

$$bx=\{3(t-1)+3\}-J\cdot Int[\{3(t-1)+2\}/J]$$

$$by=Int[\{3(t-1)+2\}/J]+1$$

In the formula above, rx, gx, and bx are the numbers of the primary colors, while each of ry, gy, and by indicates what number pixel of the primary color receives the video signal. Also, to Int[ ], a value (in the bracket) from which figures after the decimal point are omitted is supplied.

As shown in FIG. 1(*b*), the conversion of the J-primary-color video signals using the above-illustrated formula results in the output of the video signal D11 on the output terminal r(1), the output of the video signal D21 on the output terminal g(1), the output of the video signal D31 on the output terminal b(1), and the output of the video signal D41 on the output terminal r(2), and so on. In this manner, the order of the primary colors reproduced by the video signals R(t), G(t), and B(t) supplied from the source driver 3 to the image display panel 5 corresponds to the order of the primary colors of the pixels of the image display panel 5. This allows for color image reproduction by the multiple-primary-color image display panel 5, even if the source driver 3 that only has three types of input signals is adopted.

[3. Embodiment 1]

Figure 3:
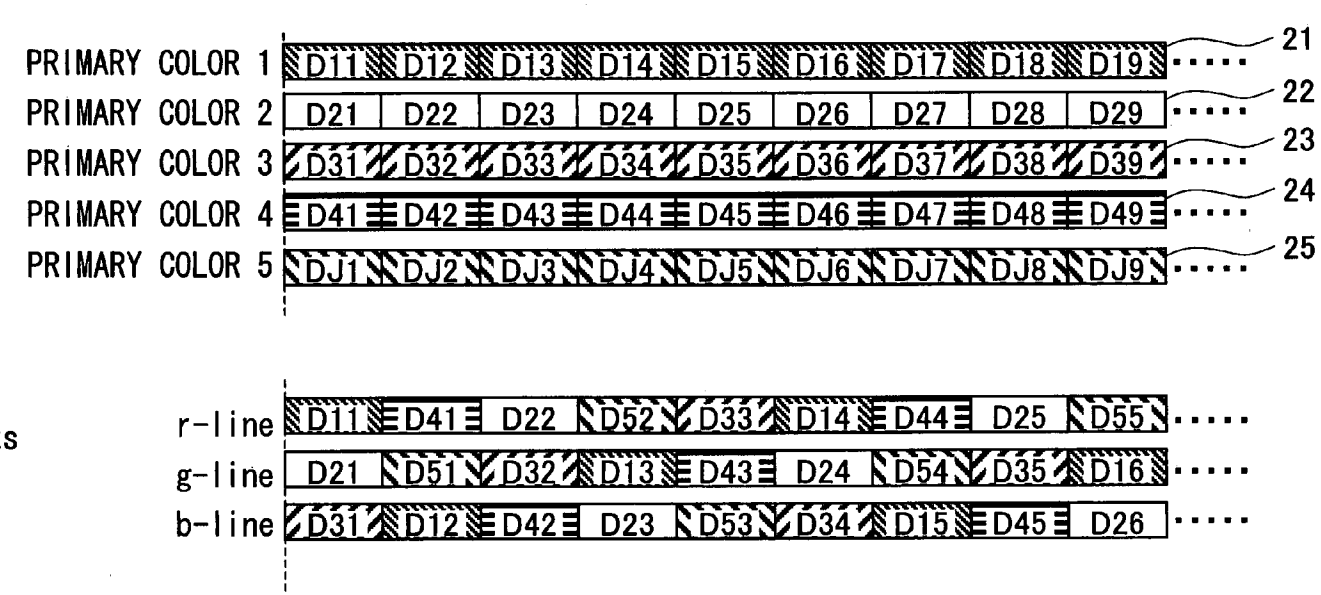
FIG. 3(*a*) shows video signals for reproducing five primary colors and video signal rows in which the video signals are reclassified into three types.
Figure 3:
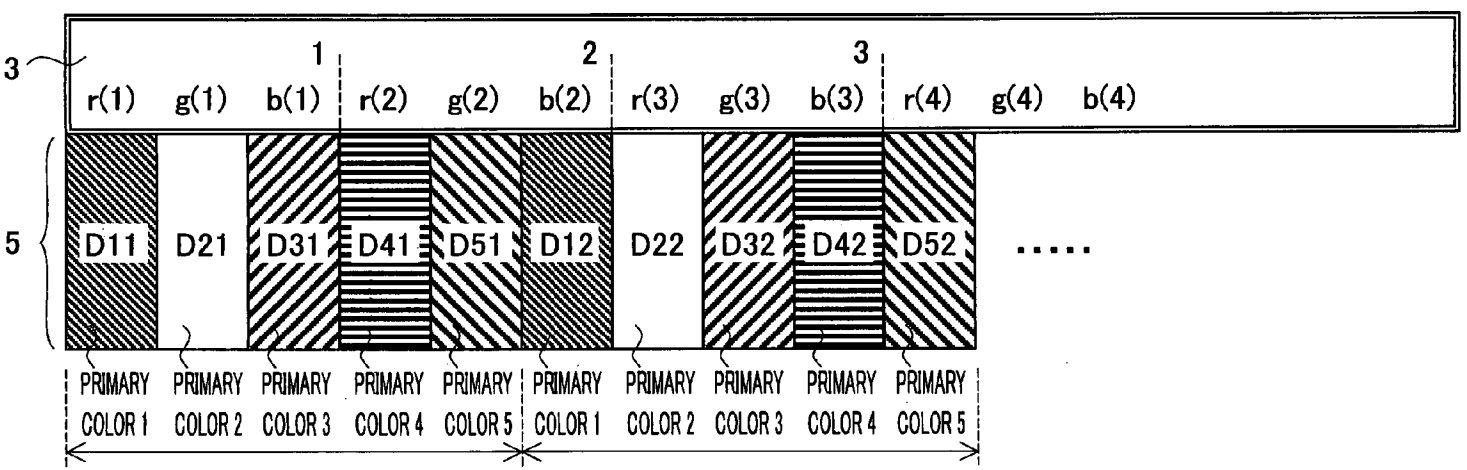

Referring to FIGS. 3(*a*) and 3(*b*), the following will discuss a case where the aforesaid signal conversion is adopted to an image display device that performs color display by five primary colors. As FIG. 3(*a*) shows, assume that video signals for color display using five primary colors are made up of signal rows 21, 22, 23, 24, and 25.

The signal row 21 is arranged such that video signals D11, D12, D13, D14 and so on for displaying the primary color 1 are aligned in line with time series. The signal row 22 is arranged such that video signals D21, D22, D23, D24 and so on for displaying the primary color 2 are aligned in line with time series. The signal row 23 is arranged such that video signals D31, D32, D33, D34 and so on for displaying the primary color 3 are aligned in line with time series. The signal row 24 is arranged such that video signals D41, D42, D43, D44 and so on for displaying the primary color 4 are aligned in line with time series. The signal row 25 is arranged such that video signals D51, D52, D53, D54 and so on for displaying the primary color 5 are aligned in line with time series.

Such video signals for displaying five primary colors are rearranged as input video signals of three types corresponding to r-line, g-line, and b-line, by substituting 5 for J in the aforesaid formula. It is noted that the signal row of the r-line is generated by aligning the video signals R(t) in the above formula, in decreasing order of integers in the brackets. The signal row of the g-line is generated by aligning the video signals G (t) in the above formula, in decreasing order of integers in the brackets. The signal row of the b-line is generated by aligning the video signals B(t) in the above formula, in decreasing order of integers in the brackets.

As shown in FIG. 3(*a*), in the r-line, the video signals D11, D41, D22, D52, D33 and so on are aligned in line with time series. In the g-line, the video signals D21, D51, D32, D13, D43 and so on are aligned in line with time series. In the b-line, the video signals D31, D12, D42, D23, D53, and so on are aligned in line with time series.

These signal rows rearranged as the video signals of three types are set in such a manner that the video signals R(t) are supplied to the image display panel 5 via the output terminals r(t) of the source driver 3, the video signals G(t) are supplied to the image display panel 5 via the output terminals g(t) of the source driver 3, and the video signals B(t) are supplied to the image display panel 5 via the output terminals b(t) of the source driver 3.

As a result, as FIG. 3(*b*) shows, the output terminal r(1) of the source driver 3 outputs the video signal D11, the output terminal g(1) outputs the video signal D21, the output terminal b(1) outputs the video signal D31, the output terminal r(2) outputs the video signal D41, and the output terminal g(2) outputs the video signal D51. In other words, the order of the primary colors reproduced by the video signals R(t), G(t), and B(t) supplied from the source driver 3 to the image display panel 5 is matched with the order of the primary colors of the pixels on the image display panel 5.

[4. Embodiment 2]

The following will describe another example of the conversion of video signals performed by the video signal processing circuit 1.

The image display panel for multiple-primary-color display is not limited to the image display panel 5 shown in FIG. 3(*b*) in which the pixels on the panel, each corresponding to one of all primary colors, are aligned in order.

Figure 4:
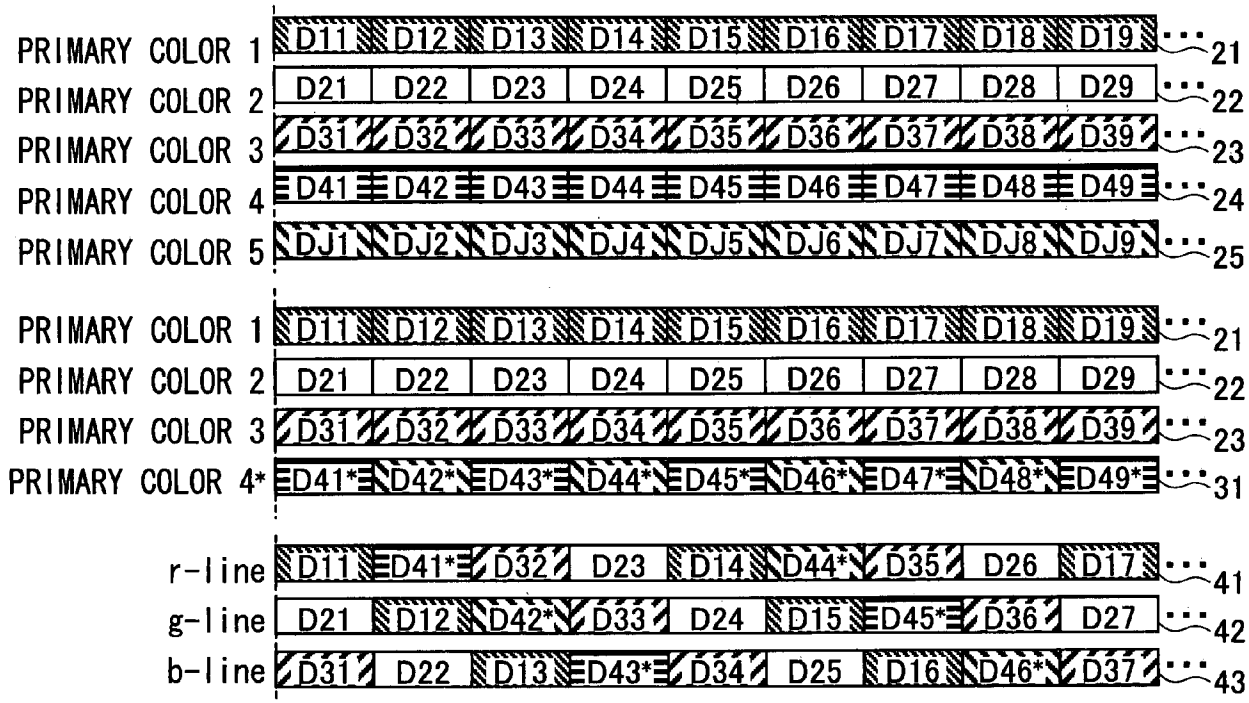
FIG. 4(*a*) shows video signals for reproducing five primary colors and video signal rows in which the video signals are reclassified into three types.
Figure 4:
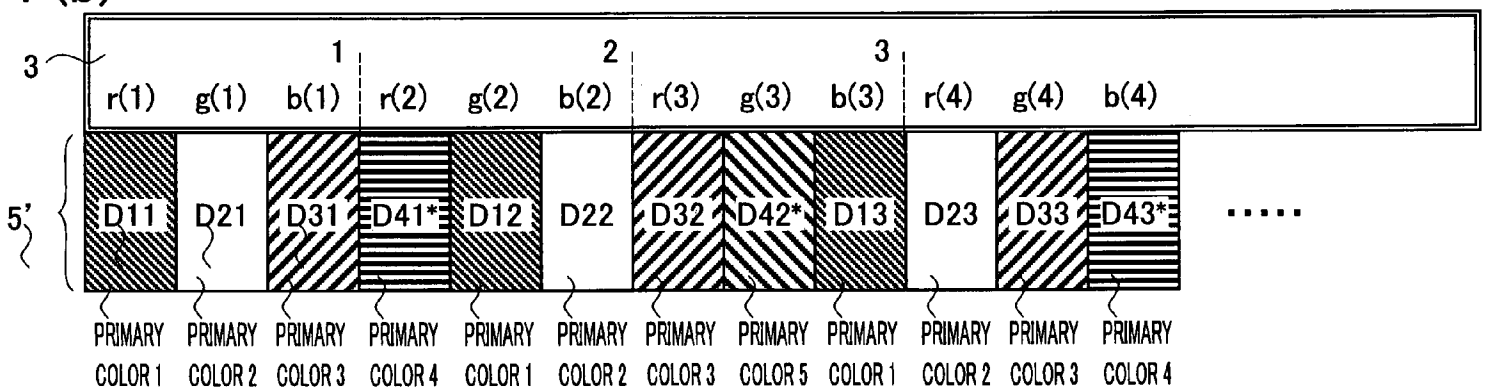

That is, as shown in FIG. 4(*b*), provided that four neighboring pixels on one gate bus line (not illustrated) are regarded as one group, there is an image display panel 5' arranged in such a manner that, while a first group includes a pixel of primary color 1, a pixel of primary color 2, a pixel of primary color 3, and a pixel of primary color 4 in this order, a group next to the first group includes a pixel of the primary color 1, a pixel of the primary color 2, a pixel of the primary color 3, and a pixel of primary color 5 in this order.

Figure 5:
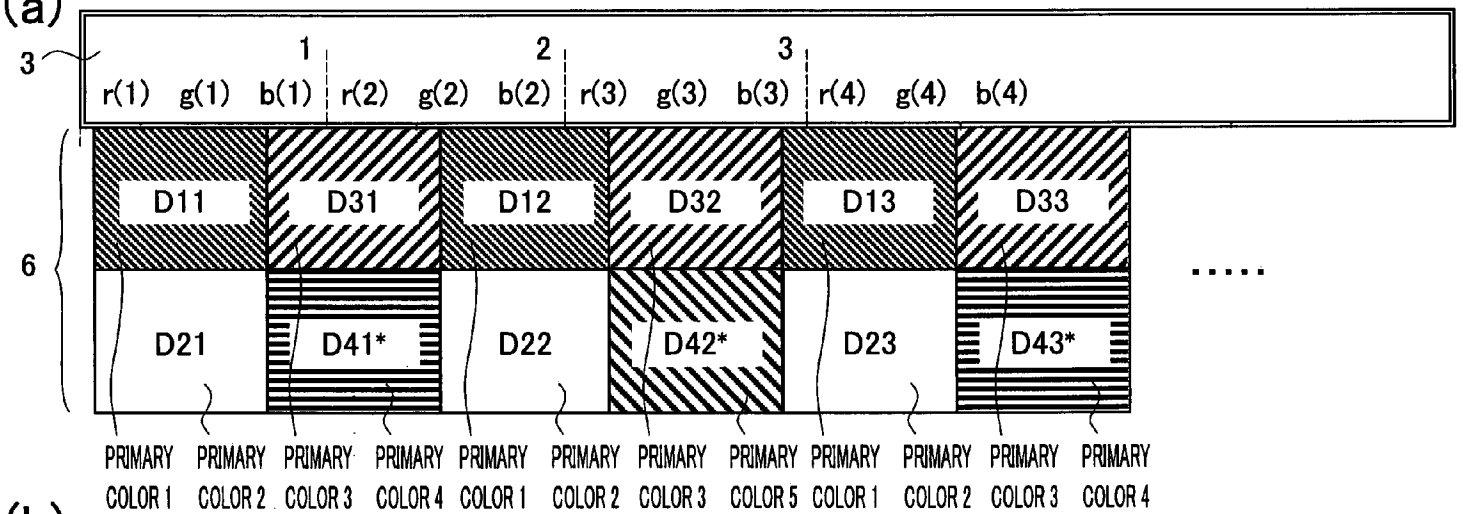
FIG. 5(*a*) shows another five-primary-color image display panel and another source driver.
Figure 5:
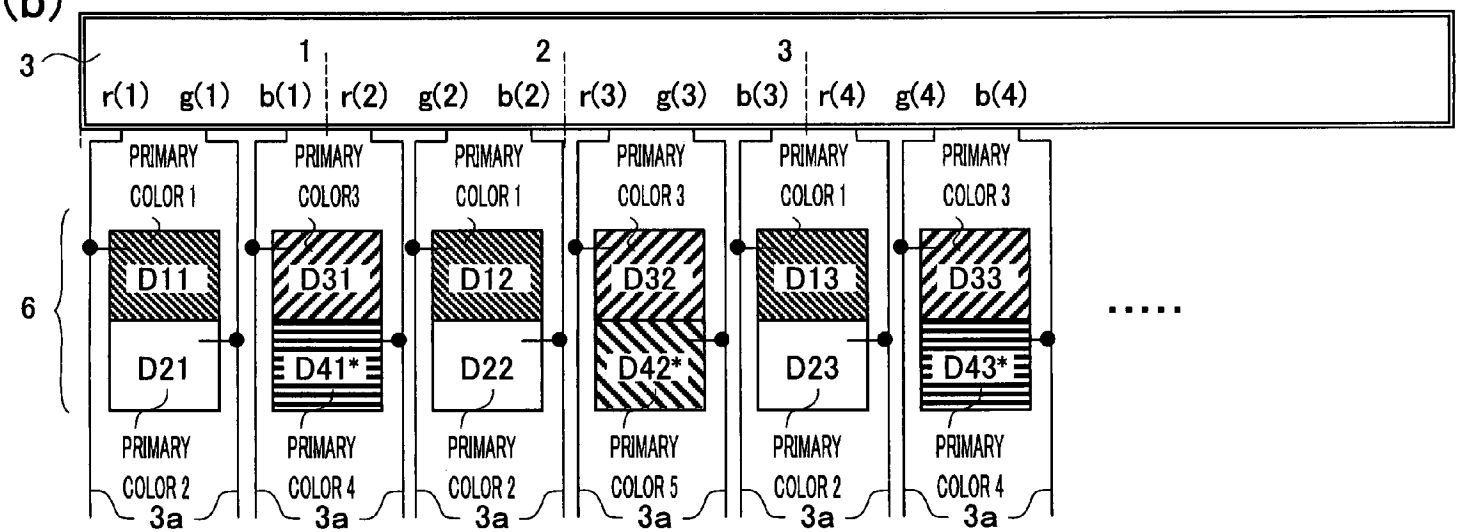

In the meanwhile, as shown in FIG. 5(*a*), there is an image display panel 6 which is arranged in such a manner that, provided that a group of four pixels is made up of (i) a set of two vertically-neighboring pixels and (ii) another set of two vertically-neighboring pixels horizontally neighboring to said set of two pixels in (i), a first group includes a pixel of the primary color 1, a pixel of the primary color 2, a pixel of the primary color 3, and a pixel of the primary color 4 in this order, while a group adjacent to the first group includes a pixel of the primary color 1, a pixel of the primary color 2, a pixel of the primary color 3, and a pixel of the primary color 5 in this order.

It is noted that, in the image display panel 6 shown in FIG. 5(*a*), source bus lines 3*a* of the source driver 3 are connected to the pixels in such a manner that, in each pair of vertically-neighboring pixels, the pixels are connected to different source bus lines 3*a*.

More specifically, the pixel of the primary color 1 is connected to the source bus line 3*a* on the left side, while the pixel of the primary color 2, which is directly below the pixel of the primary color 1, is connected to the source bus line 3*a* on the right side. In a similar manner, the pixel of the primary color 3 is connected to the source bus line 3*a* on the left side, while the pixel of the primary color 4, which is directly below the pixel of the primary color 3, is connected to the source bus line 3*a* on the right side.

In other words, the image display panel 5' and the image display panel 6 are arranged such that the groups of the pixels alternately include the pixel of the primary color 4 or the pixel of the primary color 5. To perform color image reproduction using such an image display panels 5' or 6 and the source driver 3 for three-primary-color display, five-primary-color video signals for color display are converted to three-primary-color video signals for color display, by means of the video signal processing circuit 1 (see FIG. 2).

First, as shown in FIG. 4(*a*), assume that the five-primary-color video signals for color display is made up of a signal row 21, a signal row 22, a signal row 23, a signal row 24, and a signal row 25. These signal rows 21–25 are identical with those rows of the video signals shown in FIG. 3(*a*), so that detailed descriptions thereof are omitted.

The present embodiment is different from

Embodiment 1 in a point that video signals for five-primary-color display are apparently converted to video signals for four-primary-color display.

That is, as shown in FIG. 4(*a*), a signal row 31 for reproducing primary color 4* is generated from the signal rows 24 and 25. In this signal row 31, video signals D41*, D42*, D43*, D44* and so on are aligned in line with time series.

The following will discuss how the video signals D41*, D42*, D43*, D44* and so on in the signal row 31 are generated. As described above, the signal row 31 is generated based on the signal rows 24 and 25.

For instance, the video signals D41*, D42*, D43*, D44* and so on may be generated as below.

Video Signal D41*=Video Signal D41
Video Signal D42*=Video Signal D52
Video Signal D43*=Video Signal D43
Video Signal D44*=Video Signal D54
. . .

In this way, the signal row 31 may be arranged so that the video signals of the primary color 4 and the video signals of the primary color 5 are alternately provided and hence the video signals D41, D52, D43, D54 and so on are aligned in line with time series.

Alternatively, the video signals D41*, D42*, D43*, D44* and so on may be generated as below.

(Gray Level Reproduced by Video Signal D41*)=(Gray Level Reproduced by Video Signal D41)+(Gray Level Reproduced by Video Signal D42)

(Gray Level Reproduced by Video Signal D42*)=(Gray Level Reproduced by Video Signal D51)+(Gray Level Reproduced by Video Signal D52)

(Gray Level Reproduced by Video Signal D43*)=(Gray Level Reproduced by Video Signal D43)+(Gray Level Reproduced by Video Signal D44)

(Gray Level Reproduced by Video Signal D44*)=(Gray Level Reproduced by Video Signal D53)+(Gray Level Reproduced by Video Signal D54)

In this way, the signal row 31 may be generated by alternately performing (i) the process of synthesizing two consecutive video signals of the primary color 4 and (ii) the process of synthesizing two consecutive video signals of the primary color 5. With this, the signal row 31 of the primary color 4* is generated in consideration of all video signals contained in the signal row 24 of the primary color 4 and the signal row 25 of the primary color 5.

However, in the above-described case where the gray levels reproduced by the respective two video signals are simply added up, the gray level as a result of the addition may exceed the upper limit of the gray level displayable on the image display panel 5'. In such a case, the gray level as a result of the addition is set so as to be identical with the upper limit.

The video signals D41*, D42*, D43*, D44* and so on may be generated in the following manner.

(Gray Level Reproduced by Video Signal D41*)={(Gray Level Reproduced by Video Signal D41)+(Gray Level Reproduced by Video Signal D42)}/2

(Gray Level Reproduced by Video Signal D42*)={(Gray Level Reproduced by Video Signal D51)+(Gray Level Reproduced by Video Signal D52)}/2

(Gray Level Reproduced by Video Signal D43*)={(Gray Level Reproduced by Video Signal D43)+(Gray Level Reproduced by Video Signal D44)}/2

(Gray Level Reproduced by Video Signal D44*)={(Gray Level Reproduced by Video Signal D53)+(Gray Level Reproduced by Video Signal D54)}/2

In this manner, an average value of the gray levels of two consecutive video signals may be calculated.

As described above, the video signals of five primary colors are apparently converted to the video signals for four-primary-color color display. Then the video signals R(t), G(t), and B(t) are allocated to the r-line, g-line, b-line, respectively. These video signals R(t), G(t), and B(t) are figured out by substituting 4 for J in the following formula that converts the aforesaid J-primary-color video signals to the video signals of three types.

$$R(t)=Drxry$$

$$G(t)=Dgxgy$$

$$B(t)=Dbxby$$

$$rx=\{3(t-1)+1\}-J\cdot Int[\{3(t-1)\}/J]$$

$$ry=Int[\{3(t-1)\}/J]+1$$

$$gx=\{3(t-1)+2\}-J\cdot Int[\{3(t-1)+1\}/J]$$

$$gy=Int[\{3(t-1)+1\}/J]+1$$

$$bx=\{3(t-1)+3\}\cdot J\ Int[\{3(t-1)+2\}/J]$$

$$by=Int[\{3(t-1)+2\}/J]+1$$

With this, as shown in FIG. 4(*a*), the video signals D11, D41*, D32, D23, D14, D44* and so on are aligned in the r-line, in line with time series. In the g-line, the video signals D21, D12, D42*, D33, D24, D15, and so on are aligned in line with time series. In the b-line, the video signals D31, D22, D13, D43*, D34, D25 and so on are aligned in line with time series.

Then with regard to these signal rows rearranged as the video signals of three types, the video signals R(t) are supplied from the output terminals r(t) of the source driver 3 to the image display panel 5' or the image display panel 6, the video signals G(t) are supplied from the output terminals g(t) of the source driver 3 to the image display panel 5' or the image display panel 6, and the video signals B(t) are supplied from the output terminals b(t) of the source driver 3 to the image display panel 5' or the image display panel 6.

As a result, as shown in FIG. 4(*b*) or 5(b), the output terminal r(1) of the source driver 3 outputs the video signal D11, the output terminal g(1) outputs the video signal D21, the output terminal b(1) outputs the video signal D31, the output terminal r(2) outputs the video signal D41*, and the output terminal g(2) outputs the video signal D12. Therefore, the order of the primary colors reproduced by the video signals R(t), G(t), and B(t) supplied from the source driver 3 to the image display panel 5' is matched with the order of the primary colors of the pixels on the image display panel 5'.

In the conversion above, the video signals for five-primary-color display are apparently converted into the video signals for four-primary-color display, and then further converted into the video signals of three types. The present invention is, however, not limited to this case.

The above-described signal conversion can be used in an image display panel for performing color display using K primary colors (K is an integer not less than six), the display panel being arranged such that, assuming that K-1 adjacent pixels on the image display panel are regarded as one group, a pixel with one of K primary colors and a pixel with another one of K primary colors alternate between the groups.

That is to say, one signal row is generated in the same manner as above, based on two signal rows that are used for reproducing primary colors corresponding to the pixels alternately provided between the groups each containing the K-1 adjacent pixels, and that are included in K signal rows of video signals for K-primary-color display.

[5. Embodiment 3]

Embodiments 1 and 2 assume that the number of the outputs of the source driver 3 is equal to the number of the pixels on the panel. However, since there is often limitation on the number of outputs of the source driver, an image display panel with a large number of pixels adopts more than one source driver, in order to allow the number of outputs of the source driver to be matched with the number of pixels on the panel. On this account, the total number of outputs of more than one source driver typically exceeds the number of pixels on the panel. The following will specifically discuss on this subject in reference to FIG. 6.

Figure 6:
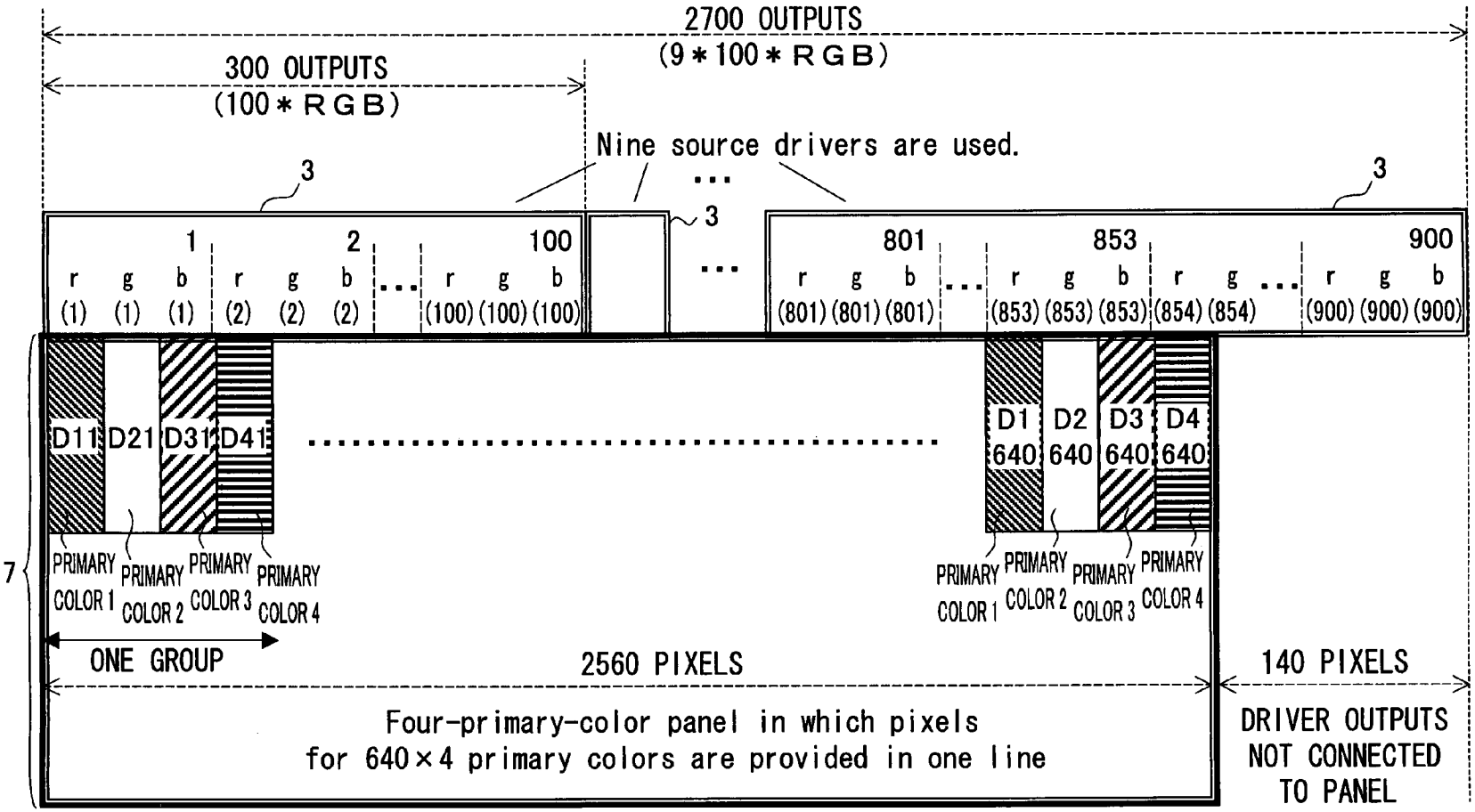
FIG. 6 shows how output terminals not connected to an image display panel are provided in the end part of a group of source drivers.

As shown in FIG. 6, an image display panel 7 of the present embodiment has 640 groups of pixels for each of four primary colors. Each of source drivers 3 has 300 r, g, and b output terminals.

The number of pixels in a single horizontal row of the image display panel 7 is 2560 (=4×640), because 640 groups are provided for each of four primary colors. On this account, to support the pixels on the image display panel 7 by the source drivers 3 each having 300 output terminals, nine source drivers 3 (having 9×300=2700 output terminals in total) are required.

As a result, the total number of output terminals of nine source drivers 3 exceeds the number of the pixels on the image display panel 7. In such a case, 140 out of 2700 (i.e. 2700−2560) output terminals of the source drivers 3 are not connected to the pixels and hence unused. When there are unused output terminals in this manner, there are four methods of connection between the image display panel 7 and the source drivers 3. FIGS. 6–9 illustrate these methods of connection.

FIG. 6 shows that the output terminals not connected to the image display panel 7 are provided on the end part of the group of the source drivers 3. In this case, the output terminal r(1) of the source driver 3 corresponds to the pixel, on the image display panel 7, to which the video signal D11 is supplied.

Figure 7:
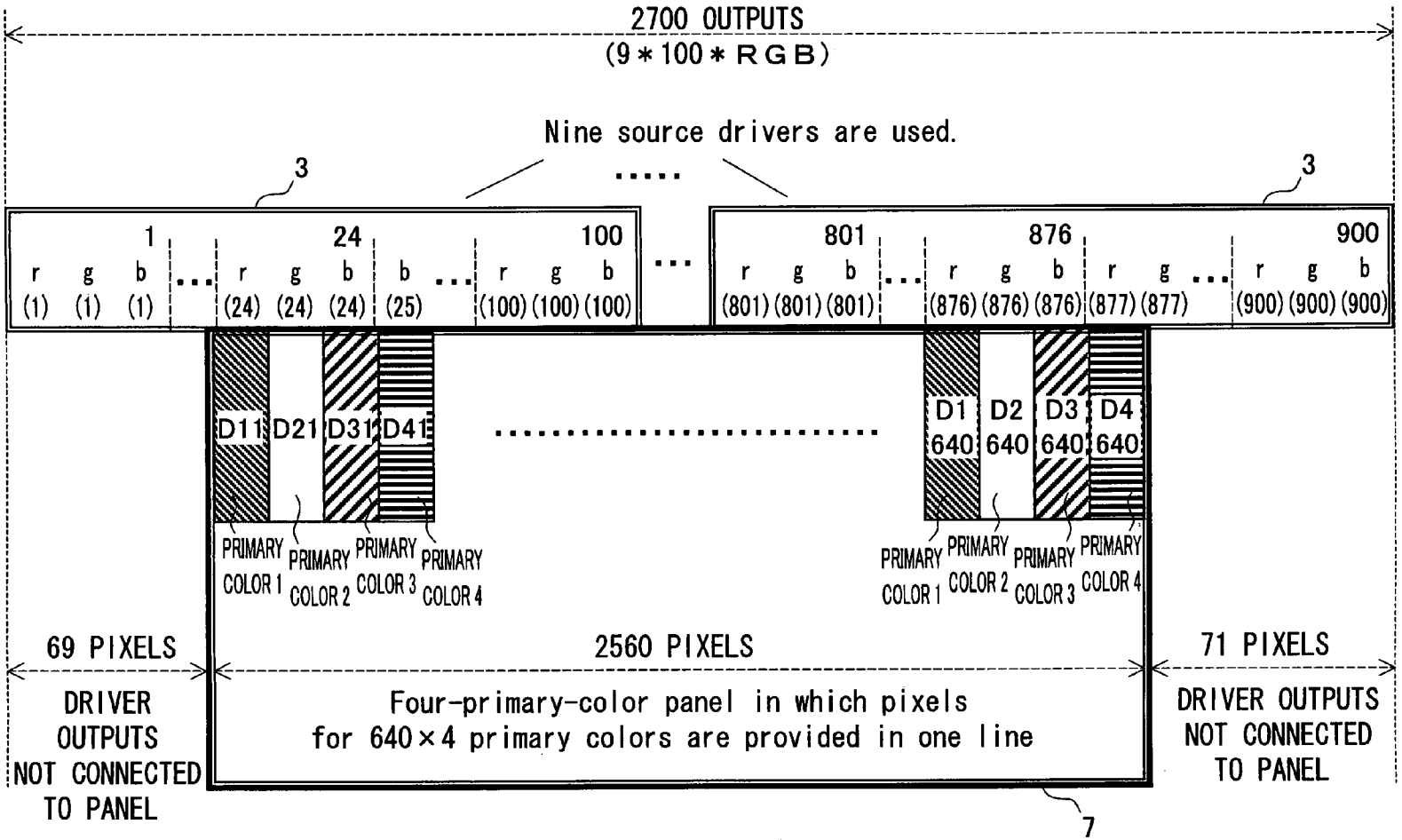
FIG. 7 shows how output terminals connected to an image display panel are provided around the central part of a group of source drivers.

FIG. 7 shows that the output terminals connected to the image display panel 7 are provided around the central part of the group of the source drivers 3. In an ideal case, 70 (140/2) output terminals are equally provided on each of the beginning part and the end part of the group of the source drivers 3.

However, since an r output terminal, a g output terminal, and a b output terminal of the source drivers 3 form one set, it is desirable that at least the beginning part of the group of the source drivers 3 is provided with output terminals whose number is around 70 and can be divided by 3. In the present embodiment, 69 unused output terminals are provided in the beginning part, while 71 unused output terminals are provided in the beginning part and the end part. In this case, the output terminal r(24) of the source drivers 3 corresponds to the pixel to which the video signal D11 is supplied.

Figure 8:
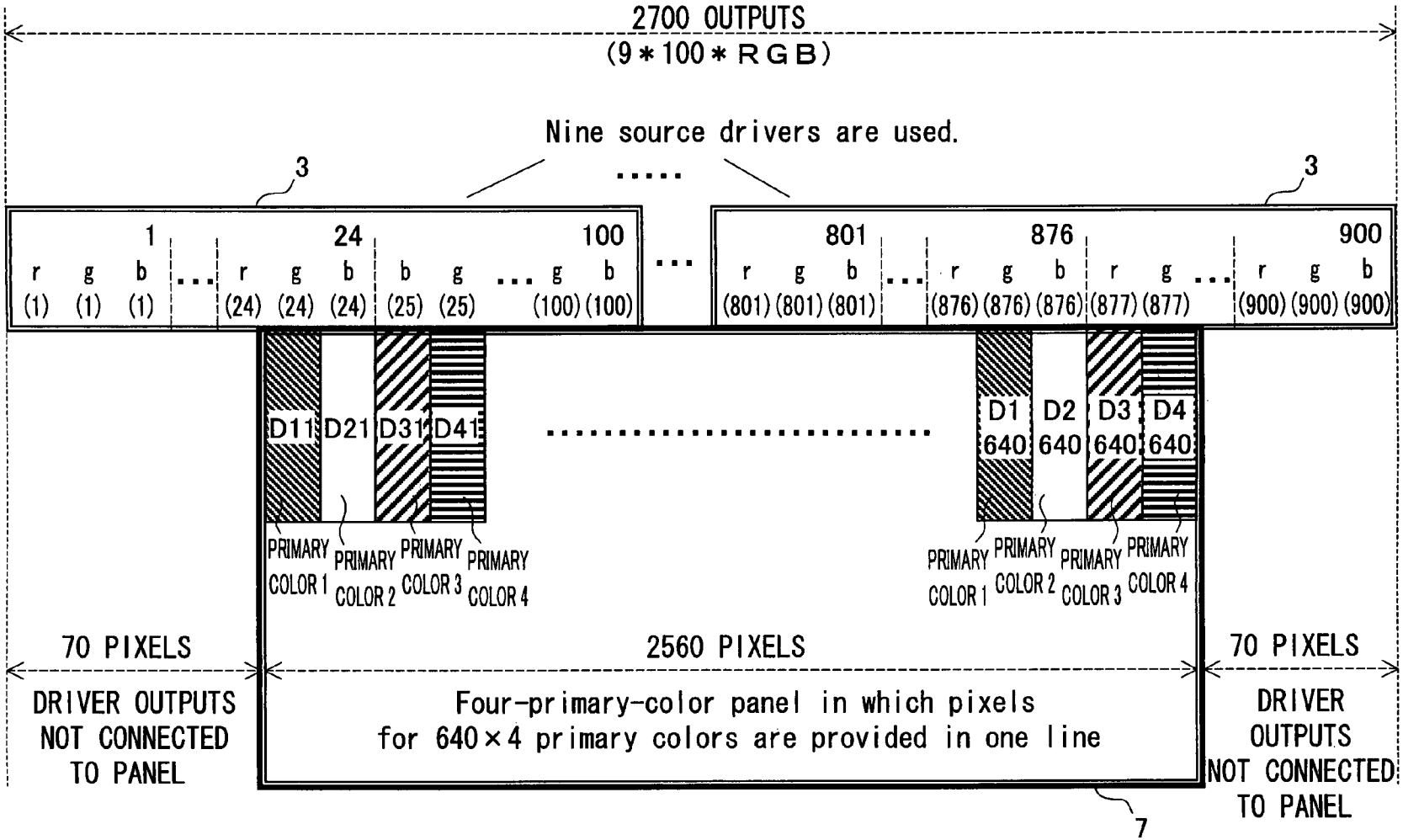
FIG. 8 shows another example of how output terminals connected to an image display panel are provided around the central part of a group of source drivers.

FIG. 8 illustrates another method of connection by which the output terminals connected to the image display panel 7 are provided around the central part of the group of the source drivers 3. In this case, in disregard for the aforesaid set of the r, g, and b terminals, 70 unused output terminals are provided in the beginning part and 70 unused output terminals are provided in the end part. In this case, the output terminal g(24) of the source drivers 3 corresponds to the pixel to which the video signal D11 is supplied. It is noted that, among the output terminals r(24), g(24), and b(24), only the output terminal r(24) is not connected to the image display panel 7.

Figure 9:
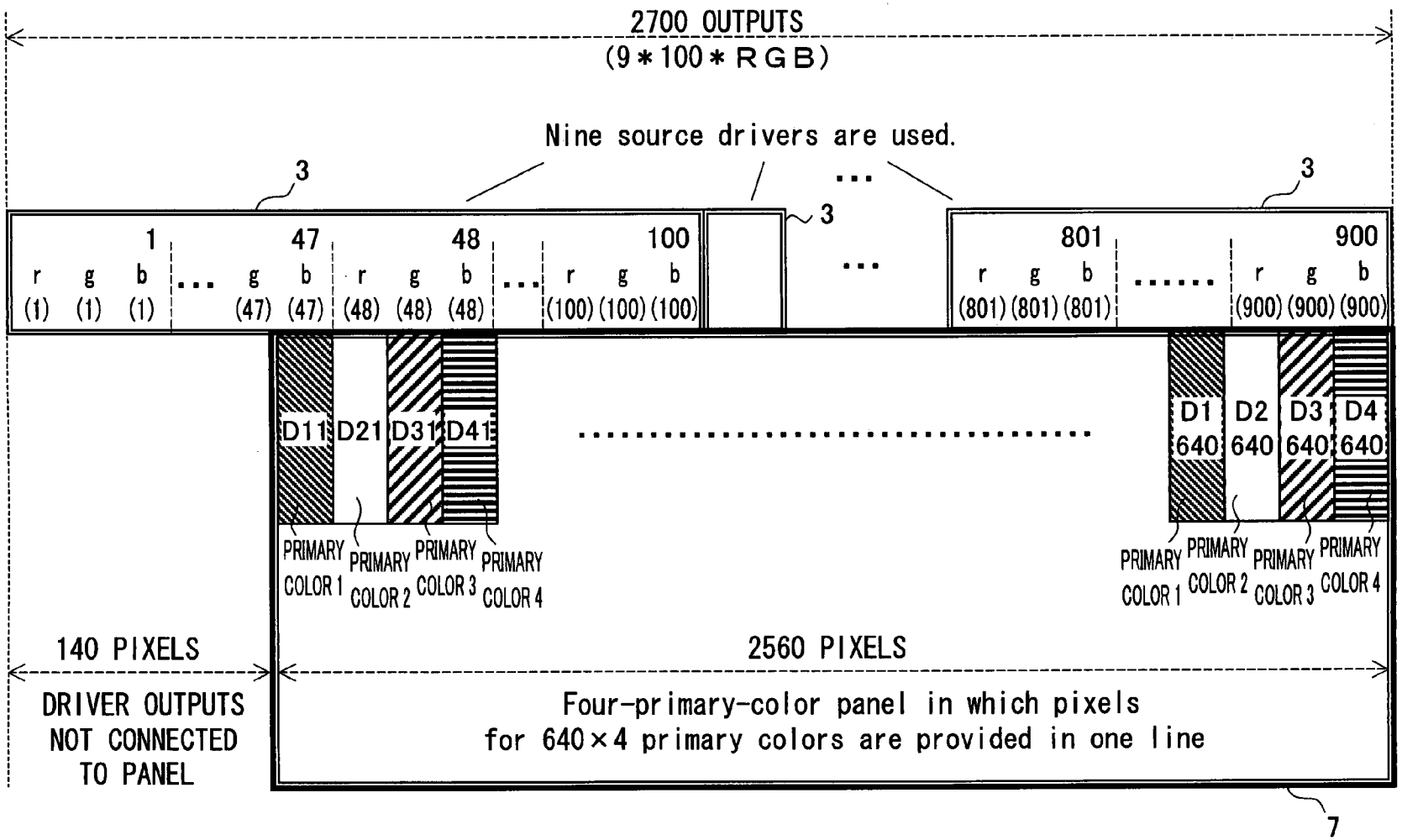
FIG. 9 shows how output terminals not connected to an image display panel are provided in the beginning part of a group of source drivers.

FIG. 9 illustrates a method of connection that the output terminals not connected to the image display panel 7 are provided in the beginning part of the group of the source drivers 3. In this case, the output terminal b(47) of the source drivers 3 corresponds to the video signal D11. Also, among the output terminals r(47), g(47), and b(47), the output terminals r(47) and g(47) are not connected to the image display panel 7.

The method of connection illustrated in FIG. 6 is identical with those described in Embodiments 1 and 2, and hence detailed descriptions thereof are omitted. The following will specifically describe the method of connection shown in FIG. 7.

As shown in FIG. 7, to cause the output terminal r(24) to be matched with the pixel to which the video signal D11 is supplied, it is assumed as if the source drivers 3 "deviate" from the output terminal r(1) to the output terminal r(24). In concrete terms, 24 is always subtracted from t.

That is, to generalize the above, provided that an amount of deviation of the source drivers 3 is S, S is subtracted from t, so that the formula used in Embodiments 1 and 2 are rewritten as below.

$$R(t)=Drxry$$

$$G(t)=Dgxgy$$

$$B(t)=Dbxby$$

$$rx=\{3(t-S)+1\}-J\cdot Int[\{3(t-S)\}/J]$$

$$ry=Int[\{3(t-S)\}/J]+1$$

$$gx=\{3(t-S)+2\}-J\cdot Int[\{3(t-S)+1\}/J]$$

$$gy=Int[\{3(t-S)+1\}/J]+1$$

$$bx=\{3(t-S)+3\}-J\cdot Int[\{3(t-S)+2\}/J]$$

$$by=Int[\{3(t-S)+2\}/J]+1$$

To Int[ ], a value (in the bracket) from which figures after the decimal point are omitted is supplied. S is a value in the bracket of the output terminal r( ) corresponding to the pixel to which the video signal D11 is supplied.

In the method of connection of the present embodiment shown in FIG. 7, the video signal D11 corresponds to the output terminal r(24), and hence the calculation is performed with the assumption of S=24. According to the formula above, the output terminal r(24) of the source drivers 3 outputs the video signal D11, the output terminal g(24) outputs the video signal D21, the output terminal b(24) outputs the video signal D31, the output terminal r(25) outputs the video signal D41, and the output terminal g(25) outputs the video signal D12.

However, if t<24, i.e. in a part corresponding to the unused output terminals, the values ry, gy, and by are either 0 or negative, and such a J-primary-color video signal is regarded as nonexistent. For this reason, t is effective only when it is not less than 24 (=S).

With this, the order of the primary colors reproduced by the video signals R(t), G(t), and B(t) supplied from the source drivers 3 to the image display panel 5 is matched with the order of the primary colors of the pixels on the image display panel 7 shown in FIG. 7.

The methods of connection illustrated in FIGS. 8 and 9 will be described more specifically. Since descriptions of these methods of connection are identical to each other, the following specifically describes the method of connection shown in FIG. 8.

In the method of connection shown in FIG. 8, the calculation is performed with the assumption of S=24 as in the case of the method of connection in FIG. 7. However, in the above-described formula, the output terminal r(24) corresponds to the pixel to which the video signal D11 is supplied, and this does not agree with FIG. 8 in which the output terminal g(24) corresponds to the pixel to which the video signal D11. This is because the above-described formula assumes that the output terminal r(S) always corresponds to the pixel to which the video signal D11 is supplied.

On this account, to accommodate the methods of connection shown in FIGS. 8 and 9, a slightly different formula must be used in a case where the output terminal g(24) (=output terminal g(S)) corresponds to the video signal D11 and a case where the output terminal b(24) (=output terminal b(S)) corresponds to the video signal D11. the following shows the formula in concrete terms.

In a case where the output terminal g(S) corresponds to the video signal D11, the formula is set as below.

$$R(t)=Drxry$$

$$G(t)=Dgxgy$$

$$B(t)=Dbxby$$

$$rx=\{3(t-S)+0\}-J\cdot Int[\{3(t-S)-1\}/J]$$

$$ry=Int[\{3(t-S)-1\}/J]+1$$

$$gx=\{3(t-S)+1\}-J\cdot Int[\{3(t-S)+0\}/J]$$

$$gy=Int[\{3(t-S)+0\}/J]+1$$

$$bx=\{3(t-S)+2\}\cdot J\cdot Int[\{3(t-S)+1\}/J]$$

$$by=Int[\{3(t-S)+1\}/J]+1$$

In a case where the output terminal b(S) corresponds to the video signal D11, the formula is set as below.

$$R(t)=Drxry$$

$$G(t)=Dgxgy$$

$$B(t)=Dbxby$$

$$rx=\{3(t-S)-1\}-J\cdot Int[\{3(t-S)-2\}/J]$$

$ry=Int[\{3(t-S)-2\}/J]+1$ $gx=\{3(t-S)+0\}J-Int[\{3(t-S)-1\}/J]$ $gy=Int[\{3(t-S)-1\}/J]+1$ $bx=\{3(t-S)+1\}-J\cdot Int[\{3(t-S)+0\}/J]$ $by=Int[\{3(t-S)+0\}/J]+1$ In these formulas, only the underlined parts are changed from the formula that illustrates the method of connection shown in FIG. 7.

To generalize these underlined parts of the formulas, $R(t)=Drxry$ $G(t)=Dgxgy$ $B(t)=Dbxby$ $rx=\{3(t-S)+A+1\}-J\cdot Int[\{3(t-S)+A\}/J]$ $ry=Int[\{3(t-S)+A\}/J]+1$ $gx=\{3(t-S)+A+2\}-J\cdot Int[\{3(t-S)+A+1\}/J]$ $gy=Int[\{3(t-S)+A+1\}/J]+1$ $bx=\{3(t-S)+A+3\}-J\cdot Int[\{3(t-S)+A+2\}/J]$ $by=Int[\{3(t-S)+A+2\}/J]+1$ (1) If $r(S)$ is $D$11, $A=0$ (2) If $g(S)$ is $D$11, $A=-1$ (3) If $b(S)$ is $D$11, $A=-2$ (To Int[ ], a value (in the bracket) from which figures after the decimal point are omitted is supplied. To S, a number in any one of the brackets r( ), g( ), and b( ) corresponding to the video signal D11, after the classification into (1)-(3), is returned.)

In the method of connection shown in FIG. 8 of the present embodiment, the video signal D11 corresponds to the output terminal g(24). Therefore, substituting −1 for A and 24 for S in the formula, the output terminal g(24) of the source drivers 3 outputs the video signal D11, the output terminal b(24) outputs the video signal D21, the output terminal r(24) outputs the video signal D31, the output terminal g(25) outputs the video signal D41, and the output terminal b(25) outputs the video signal D12.

However, if t<24 (=S), i.e. with regard to a part corresponding to the unused output terminals, the values ry, gy, by, and so on are either 0 or negative, so that such a J-primary-color video signal is regarded as nonexistent. The value t is therefore not effective unless t is not less than 24. Also when t=24, ry=0 so that the video signal on the output terminal r(24) does not exist.

With this, the order of the primary colors reproduced by the video signals R(t), G(t), and B(t) supplied from the source drivers 3 to the image display panel 7 is matched with the order of the primary colors of the pixels of the image display panel 7.

In the method of connection in FIG. 9 of the present embodiment, the video signal D11 corresponds to the output terminal b(47). Therefore, substituting −2 for A and 47 for S in the above-described formula, the output terminal b(47) of the source drivers 3 outputs the video signal D11, the output terminal r(48) outputs the video signal D21, the output terminal g(48) outputs the video signal D31, the output terminal b(48) outputs the video signal D41, and the output terminal r(49) outputs the video signal D12.

If t<47 (=S), i.e. in a part corresponding to the unused output terminals, the values ry, gy, and by are either 0 or negative, and such a J-primary-color video signal is regarded as nonexistent. Also, if t=47, ry and gy are 0 so that the video signals outputted from the output terminals r(47) and g(47) are nonexistent.

With the arrangement above, the order of the primary colors reproduced by the video signals R(t), G(t), and B(t) supplied from the source drivers 3 to the image display panel 7 is matched with the order of the primary colors of the pixels of the image display panel 7 shown in FIG. 9.

As a matter of course, the conversion of the video signals of J types into the video signals of three types illustrated in Embodiment 3 may be replaced with the conversion illustrated in Embodiment 2. That is to say, it is possible to adopt such an arrangement that, after the video signals of J types are rearranged to the video signals of (J−1) types, these video signals of (J−1) types are rearranged to the video signals of three types.

To rearrange the video signals of J types to the video signals of (J−1) types, the process described in Embodiment 2 can be used. That is, either one of the following two processes can be used:

(1) A process in which video signals are fetched from two video signal rows that are arbitrarily selected from the video signal rows of J types, while alternately selecting the two video signal rows from which the video signals are extracted, and the fetched video signals are aligned in line with time series, so that one video signal row is generated; or (2) A process in which, with regard to two video signal rows that are arbitrarily selected from video signal rows of J types, video signals whose order in each video signal row is identical are synthesized, and the synthesized video signals are aligned in line with time series, so that one video signal row is generated.

[6. Additional Comments]

In the descriptions above, as shown in, for example, FIG. 1(*b*), the left end of the source driver 3 is matched with the left end of the image display panel 5. The present invention is, however, not limited to this arrangement. The present invention can be applied also to a case where the left end of the source driver 3 is not matched with the left end of the image display panel 5.

The video signal processing circuit of the present invention may be rephrased as a video signal processing method comprising the steps of: (i) for each of J primary colors (J is an integer not less than 4) for image display on the image display device, three video signals are fetched in order, in accordance with the order of some of the J primary colors of the pixels on the image display devices, the video signals being fetched form video signal rows of J types in each of which the video signals supplied to the pixels are aligned in line with time series; and (ii) generating video signal rows of three types by allocating each of the three video signals fetched in the step (i) to one of the video signal rows of three types.

These steps in the video signal processing method may be realized by causing computing means such as a CPU to perform a program stored in storage means such as ROM (Read Only Memory) and RAM, so as to control input means such as a keyboard, output means such as a display, and communication means such as an interface circuit.

On this account, the processes of the signal processing circuit of the present embodiment may be realized only by causing a computer including the aforesaid means to read a storage medium storing the aforesaid program and run the program. Storing the program in a removable storage medium, it is possible to realize the aforesaid functions and processes on any computer.

Such a storage medium may be a memory (not shown), such as a ROM, so that the process is executable on a microcomputer. Alternatively, a program medium may be used which can be read by inserting the storage medium in an external storage device (program reader device; not shown).

In addition, in either of the cases, it is preferable if the contained program is accessible to a microprocessor which will execute the program. Further, it is preferable if the program is read, and the program is then downloaded to a program storage area of a microcomputer where the program is executed. Assume that the program for download is stored in a main body device in advance.

In addition, the program medium is a storage medium arranged so that it can be separated from the main body. Examples of such a program medium include a tape, such as a magnetic tape and a cassette tape; a magnetic disk, such as a flexible disk and a hard disk; a disc, such as a CD/MO/MD/DVD; a card, such as an IC card (inclusive of a memory card); and a semiconductor memory, such as a mask ROM, an EPROM (erasable programmable read only memory), an EEPROM (electrically erasable programmable read only memory), or a flash ROM. All these storage media hold a program in a fixed manner.

Alternatively, if a system can be constructed which can connects to the Internet or other communications network, it is preferable if the program medium is a storage medium carrying the program in a flowing manner as in the downloading of a program over the communications network.

Further, when the program is downloaded over a communications network in this manner, it is preferable if the program for download is stored in a main body device in advance or installed from another storage medium.

According to the present invention, multiple primary colors in accordance with multiple-primary-color video signals can be reproduced by a panel adopting a typical three-primary-color source driver. This makes it possible to inexpensively manufacture an image display device reproducing images with multiple primary colors, e.g. PC monitors, liquid crystal TVs, projectors, and mobile phones.

As described above, a video signal processing circuit, which converts video signals supplied to pixels disposed in a matrix manner on an image display panel, is characterized in that, with regard to each of J (J is an integer not less than four) primary colors for image display on the image display panel, (i) three video signals are extracted from each of video signal rows of J types in which the video signals are aligned in line with time series, in such a manner as to cause an order of primary colors reproduced by the three video signals to be in line with an order of the J primary colors allocated to the respective pixels, and (ii) video signal rows of three types are generated by serially allocating each of the three video signals to any one of the video signal rows of three types.

Also, a video signal processing method, by which video signals supplied to pixels provided in a matrix manner on an image display device are converted, is characterized by comprising the steps of: (i) with regard to each of J (J is an integer not less than four) primary colors for image display on the image display device, extracting, from each of video signal rows of J types in which the video signals are aligned in line with time series, three video signals in such a manner as to cause an order of primary colors reproduced by the three video signals to be in line with an order of the J primary colors allocated to the respective pixels, and (ii) generating video signal rows of three types by serially allocating each of the three video signals to any one of the video signal rows of three types.

In the image display panel on which the pixels are provided in a matrix manner, image reproduction is carried out by performing matrix-driving of the pixels using the source driver and the gate driver.

However, in a case where the image display panel reproduces images using not less than four primary colors, one of the not less than four primary colors is allocated to each pixel. When a source driver whose number of input/output types is identical with the number of primary colors used for image reproduction is adopted to the aforesaid image display panel that reproduces images using multiple primary colors, the manufacturing costs of an image display device including the image display panel are high, because the aforesaid source driver is not in general use.

Taking this problem into account, the video signal processing circuit and the video signal processing method of the present invention are arranged in such a manner that, three video signals are extracted from video signal rows of J types in which the video signals are aligned in line with time series, in such a manner as to cause an order of primary colors reproduced by the three video signals to be in line with an order of the J primary colors allocated to the respective pixels. Then, in the present invention, video signal rows of three types are generated by serially allocating each of the three video signals to any one of the video signal rows of three types. With this, the order of the primary colors reproduced by the extracted three video signals is not disturbed. In other words, the video signal rows of three types generated by the video signal processing circuit of the present invention include the video signals aligned in the order corresponding to the order of the J primary colors on the image display panel.

On this account, the video signals are outputted in the order corresponding to the order of the J primary colors on the image display panel, by outputting, to the source driver with three input/output types, the video signal rows of three types supplied in accordance with the video signal processing circuit and the video signal processing method of the present invention. Therefore, the video signal rows of three types supplied from the video signal processing circuit of the present invention are serially outputted from the source driver with three input/output types, so that the video signals are outputted in the order corresponding to the order of the J primary colors on the image display panel. In short, the video signal processing circuit and the video signal processing method of the present invention allow for image reproduction with J primary colors, using a source driver having three input/output types.

Such a source driver having three input/output types is in general use, e.g. used in typical liquid crystal image display panels that reproduce images using RGB colors. On this account, the video signal processing circuit and the video signal processing method of the present invention allow for image reproduction with J primary colors, using a general-use source driver, so that the manufacturing costs for the image display device are saved.

In the aforesaid video signal processing circuit of the present invention, the following arrangement is preferably adopted: the video signal rows of J types are rearranged to the video signal rows of three types, in accordance with a formula:

$$R(t)=Drxry$$

$$G(t)=Dgxgy$$

$$B(t)=Dbxby,$$

where:

$$rx=\{3(t-1)+1\}-J\cdot Int[\{3(t-1)\}/J]$$

$$ry=Int[\{3(t-1)\}/J]+1$$

$$gx=\{3(t-1)+2\}-J\cdot Int[\{3(t-1)+1\}/J]$$

$$gy=Int[\{3(t-1)+1\}/J]+1$$

$$bx=\{3(t-1)+3\}-J\cdot Int[\{3(t-1)+2\}/J]$$

$$by=Int[\{3(t-1)+2\}/J]+1,$$

(i) Dmn represents the video signals included in the video signal rows of J types (11, 12, . . . ), (ii) m is an integer in a range between 1 and J, (iii) n is an integer indicating to what number pixel of each primary color a video signal is supplied, (iv) R(t), G(t), and B(t) represent video signals included in the video signal rows of three types, (v) t is an integer indicating an order of a video signal in an associated video signal row, and (vi) to Int[ ], a value in a bracket, from which figures after the decimal point are omitted, is entered.

According to this arrangement, the video signal rows of J types are rearranged to the video signal rows of three types, in accordance with the predetermined formula above.

That is to say, in the formula above, the video signal rows of J types are represented as below. Note that, for the sake of simplicity, J is set at 5.

Video signal row of primary color 1: video signal row made up of video signals D11, D12, D13, and so forth;

Video signal row of primary color 2: video signal row made up of video signals D21, D22, D23, and so forth;

. . .

Video signal row of primary color 5: video signal row made up of video signals D51, D52, D53, and so forth.

Note that, in the present case, the primary colors 1, 2, 3, 4, and 5 are allocated in this order to the pixels on the image display panel.

Working out rx, ry, gx, gy, bx, and by by setting t=1, 2, 3, . . . in the formula above (i.e. substituting integers arranged in an ascending order for t in the formula above), the video signals R(t), G(t) and B(t) are calculated as below.

R(t): video signals D11, D41, D22 and so forth

G(t): video signals D21, D51, D32 and so forth

B(t): video signals D31, D12, D42 and so forth

In other words, the above-mentioned video signal rows of five types are converted into the following video signal rows of three types.

First type: video signals D11, D41, D22, and so forth

Second type: video signals D21, D51, D32 and so forth

Third type: video signals D31, D12, D42 and so forth

In these video signal rows of three types being thus converted, the first video signals in the respective types are the video signals D11, D21, and D31 that correspond to the primary colors 1, 2, and 3, respectively. This indicates that the video signal rows of five types are converted into the video signal rows of three types, in accordance with the order of five primary colors on the image display panel.

On this account, the video signal rows of three types supplied from the video signal processing circuit of the present invention are serially outputted from the source driver having three input/output types, so that the video signals are outputted in the order corresponding to the order of five primary colors on the image display panel. Therefore, the video signal processing circuit of the present invention allows for image reproduction with five primary colors, using a source driver having three input/output types.

In particular, in the present invention, the video signal rows of three types are generated in accordance with a predetermined formula. This makes it possible to easily convert video signal rows of J types into video signal rows of three types. For this reason, the manufacturing costs of the image display device are reduced by adopting a general-use source driver, and also processes performed in the video signal processing circuit are simplified.

In the aforesaid video signal processing circuit of the present invention, the following arrangement may be adopted: the video signal rows of J types are converted into video signal rows of (J−1) types, by (i) extracting video signals from two video signal rows that are arbitrarily selected from the video signal rows of J types, while alternately selecting the two video signal rows from which the video signals are extracted, and (ii) generating one video signal row by aligning the extracted video signals in line with time series, and the video signal rows of (J−1) types are rearranged to the video signal rows of three types, in accordance with a formula:

$$R(t)=Drxry$$

$$G(t)=Dgxgy$$

$$B(t)=Dbxby,$$

where:

$$rx=\{3(t-1)+1\}-(J-1)\cdot Int[\{3(t-1)\}/(J-1)]$$

$$ry=Int[\{3(t-1)\}/(J-1)]+1$$

$$gx=\{3(t-1)+2\}-(J-1)\cdot Int[\{3(t-1)+1\}/(J-1)]$$

$$gy=Int[\{3(t-1)+1\}/(J-1)]+1$$

$$bx=\{3(t-1)+3\}-(J-1)\cdot Int[\{3(t-1)+2\}/(J-1)]$$

$$by=Int[\{3(t-1)+2\}/(J-1)]+1,$$

(I) Dmn represents the video signals included in the video signal rows of (J−1) types, (II) m is an integer in a range between 1 and J−1, (III) n is an integer indicating to what number pixel of each primary color a video signal is supplied, (IV) R(t), G(t), and B(t) represent video signals in the video signal rows of three types, (V) t is an integer indicating an order of a video signal in an associated video signal row, and (VI) to Int[ ], a value in a bracket, from which figures after the decimal point are omitted, is entered.

In the image display panel that reproduces images using J primary colors, each of J primary colors does not always one-to-one correspond to each pixel. That is to say, assuming that (J−1) pixels on the image display panel form a group, there is an image display panel in which two of J primary colors are alternately provided between the groups.

When, on such an image display panel, image reproduction is carried out using video signal rows of three types generated by converting the video signal rows of J types in accordance with the aforesaid formula, image reproduction may not be suitably carried out because the primary colors of the respective pixels are not matched with the primary colors reproduced by the video signals supplied to the respective pixels.

For this reason, in the present invention, the video signal rows of J types are converted into video signal rows of (J−1) types, by (i) extracting video signals from two video signal rows that are arbitrarily selected from the video signal rows of J types, while alternately selecting the two video signal rows from which the video signals are extracted, and (ii) generating one video signal row by aligning the extracted video signals in line with time series.

Assume that J=5, i.e. assume that one of the primary colors 1, 2, 3, 4, and 5 is allocated to each pixel on the image display panel. Furthermore, assume that, on the image display panel, four pixels are treated as one group and the primary colors 4 and 5 are alternately provided between the groups.

In such a case, the conversion of the video signals in the present invention is arranged such that one video signal row is generated from the video signal row for reproducing the primary color 4 and the video signal row for reproducing the primary color 5.

More specifically, provided that a signal row generated from the video signal rows of the primary colors 4 and 5 is regarded as a video signal row of primary color 4*, this video signal row of the primary color 4* is arranged as below.

Video signal row of primary color 4*: video signals D41, D52, D43 and so forth.

In accordance with the formula above, the video signal rows of the primary colors 1, 2, 3, and 4* are converted into the video signals of three types R(t), G(t), and B(t), in the following manner.

First type: video signals D11, D41, D32 and so forth

Second type: video signals D21, D12, D52, and so forth

Third type: video signals D31, D22, D13 and so forth

From these video signal rows of three types as a result of the conversion, the video signals are outputted in the order of the first type, second type, and third type. According to this arrangement, initially-outputted video signals are the video signals D11, D21, D31, and D41 that correspond to the primary colors 1, 2, 3, and 4, respectively. The video signals to be outputted next are the video signals D12, D22, D32, and D52 corresponding to the primary colors 1, 2, 3, and 5, respectively.

In this manner, in the video signal rows of three types being thus converted by the video signal processing circuit of the present invention, the video signal of the primary color 4 and the video signal of the primary color 5 are alternately outputted, assuming that four video signals form one unit.

On this account, the video signal rows of three types supplied from the video signal processing circuit of the present invention are serially outputted from the source driver having three input/output types, so that the video signals are outputted in the order corresponding to the order of five primary colors on the image display panel. Therefore, the video signal processing circuit of the present invention allows for image reproduction with J primary colors, using a source driver having three input/output types.

In particular, in the present invention, the video signal rows of three types are generated in accordance with a predetermined formula. This makes it possible to easily convert video signal rows of J types into video signal rows of three types. For this reason, the manufacturing costs of the image display device are reduced by adopting a general-use source driver, and also processes performed in the video signal processing circuit are simplified.

In the aforesaid video signal processing circuit of the present invention, the following arrangement may be adopted: in regard to two video signal rows arbitrarily selected from the video signal rows of J types, video signals whose orders in the respective two video signal rows are identical are synthesized, one video signal row is generated by aligning the synthesized video signals in line with time series, and consequently the video signal rows of J types are converted into video signal rows of (J−1) types, and the video signal rows of (J−1) types are rearranged to the video signal rows of three types, in accordance with a formula:

$$R(t)=Drxry$$

$$G(t)=Dgxgy$$

$$B(t)=Dbxby,$$

where:

$$rx=\{3(t-1)+1\}-(J-1)\cdot Int[\{3(t-1)\}/(J-1)]$$

$$ry=Int[\{3(t-1)\}/(J-1)]+1$$

$$gx=\{3(t-1)+2\}-(J-1)\cdot Int[\{3(t-1)+1\}/(J-1)]$$

$$gy=Int[\{3(t-1)+1\}/(J-1)]+1$$

$$bx=\{3(t-1)+3\}-(J-1)\cdot Int[\{3(t-1)+2\}/(J-1)]$$

$$by=Int[\{3(t-1)+2\}/(J-1)]+1,$$

(i) Dmn represents the video signals included in the video signal rows of (J−1) types, (ii) m is an integer in a range between 1 and J−1, (iii) n is an integer indicating to what number pixel of each primary color a video signal is supplied, (iv) R(t), G(t), and B(t) represent video signals in the video signal rows of three types, (v) t is an integer indicating an order of a video signal in an associated video signal row, and (vi) to Int[ ], a value in a bracket, from which figures after the decimal point are omitted, is entered.

As described above, assuming that (J−1) pixels on the image display panel form a group, there is an image display panel in which two of J primary colors are alternately provided between the groups.

When, on such an image display panel, image reproduction is carried out using video signal rows of three types generated by converting the video signal rows of J types in accordance with the aforesaid formula, image reproduction may not be suitably carried out because the primary colors of the respective pixels are not matched with the primary colors reproduced by the video signals supplied to the respective pixels.

For this reason, in the present invention, in regard to two video signal rows arbitrarily selected from the video signal rows of J types, video signals whose orders in the respective two video signal rows are identical are synthesized, one video signal row is generated by aligning the synthesized video signals in line with time series, and consequently the video signal rows of J types are converted into video signal rows of (J−1) types. It is noted that "synthesizing the video signals" is to add up gray levels indicated by the respective video signals.

Assume that J=5, i.e. one of primary colors 1, 2, 3, 4, and 5 is allocated to each pixel on the image display panel, and, on the premise that four pixels form one group, the primary colors 4 and 5 are alternately provided between the groups, on the image display panel.

With these assumptions, the conversion of the video signals of the present invention is performed such that one video signal row is generated from the video signal row for reproducing the primary color 4 and the video signal row for reproducing the primary color 5.

More specifically, provided that a signal row generated from the video signal rows of the primary colors 4 and 5 is a video signal row of primary color 4*, this video signal row of the primary color 4* is arranged as below.

(Gray Level Reproduced by Video Signal D41*)={(Gray Level Reproduced by Video Signal D41)+(Gray Level Reproduced by Video Signal D42)}/2

(Gray Level Reproduced by Video Signal D42*)={(Gray Level Reproduced by Video Signal D51)+(Gray Level Reproduced by Video Signal D52)}/2

(Gray Level Reproduced by Video Signal D43*)={(Gray Level Reproduced by Video Signal D43)+(Gray Level Reproduced by Video Signal D44)}/2

(Gray Level Reproduced by Video Signal D44*)={(Gray Level Reproduced by Video Signal D53)+(Gray Level Reproduced by Video Signal D54)}/2

. . .

Then the following is obtained by converting, in accordance with the formula above, the video signal rows of the primary colors 1, 2, 3, and 4* into the video signals R(t), G(t), and B(t) of three types.

First type: video signals D11, D41*, D32 and so forth

Second type: video signals D21, D12, D42* and so forth

Third type: video signals D31, D22, D13, and so forth

From these video signal rows of three types thus converted, the video signals are outputted in the order of the first type, the second type, and the third type. As a result of this, the initially-outputted video signals are D11, D21, D31, and D41* corresponding to the primary colors 1, 2, 3, and 4, respectively. The video signals to be outputted next are D12, D22, D32, and D42* corresponding to the primary colors 1, 2, 3, and 5, respectively.

In this manner, in the video signal rows of three types being thus converted by the video signal processing circuit of the present invention, the video signal of the primary color 4 and the video signal of the primary color 5 are alternately outputted, assuming that four video signals form one unit.

On this account, the video signal rows of three types supplied from the video signal processing circuit of the present invention are serially outputted from the source driver having three input/output types, so that the video signals are outputted in the order corresponding to the order of five primary colors on the image display panel. Therefore, the video signal processing circuit of the present invention allows for image reproduction with J primary colors, using a source driver having three input/output types.

In particular, in the present invention, the video signal rows of three types are generated in accordance with a predetermined formula. This makes it possible to easily convert video signal rows of J types into video signal rows of three types. For this reason, the manufacturing costs of the image display device are reduced by adopting a general-use source driver, and also processes performed in the video signal processing circuit are simplified.

Furthermore, according to the present invention, in regard to two video signal rows arbitrarily selected from the video signal rows of J types, video signals whose orders in the respective two video signal rows are identical are synthesized, and one video signal row is generated by aligning the synthesized video signals in line with time series. On this account, the video signal rows of three types are generated in consideration of all video signals included in the video signal rows of J types. This allows for image reproduction with suitable colors.

To solve the above-described problem, a video signal processing circuit of the present invention may be arranged in such a manner that, the video signal rows of J types are rearranged to the video signal rows of three types, in accordance with a formula:

$$R(t)=Drxry$$

$$G(t)=Dgxgy$$

$$B(t)=Dbxby,$$

where:

$$rx=\{3(t-S)+A+1\}-J\cdot Int[\{3(t-S)+A\}/J]$$

$$ry=Int[\{3(t-S)+A\}/J]+1$$

$$gx=\{3(t-S)+A+2\}-J\cdot Int[\{3(t-S)+A+1\}/J]$$

$$gy=Int[\{3(t-S)+A+1\}/J]+1$$

$$bx=\{3(t-S)+A+3\}-J\cdot Int[\{3(t-S)+A+2\}/J]$$

$$by=Int[\{3(t-S)+A+2\}/J]+1, \text{ and}$$

(1) If the video signal D11 is supplied to the output terminal r(S), A=0

(2) If the video signal D11 is supplied to the output terminal g(S), A=−1

(3) If the video signal D11 is supplied to the output terminal b(S), A=−2, (i) Dmn represents the video signals included in the video signal rows of J types, (ii) m is an integer in a range between 1 and J, (iii) n is an integer indicating to what number pixel of each primary color a video signal is supplied, (iv) R(t), G(t), and B(t) represent video signals included in the video signal rows of three types, (v) t is an integer indicating an order of a video signal in an associated video signal row, (vi) r(1), g(1), b(1) represent output terminals of three types in a source driver, (vii) 1 is an integer indicating an order of an output terminal in an associated type, (viii) a video signal D11 among the video signals of J types is supplied to one of an output terminal r(S), an output terminal g(S), and an output terminal b(S), (ix) to Int[ ], a value in a bracket, from which figures after the decimal point are omitted, is entered, and (x) S is a number in one of brackets in output terminals r( ), g( ), and b( ) corresponding to the video signal D11, in a case where classification into (1)-(3) is carried out.

In the formula above, the video signal rows of J types are represented as below. Note that, J is set at 4 for the sake of simplicity.

Video signal row of primary color 1: video signal row made up of video signals D11, D12, D13, and so forth.

Video signal row of primary color 2: video signal row made up of video signals D21, D22, D23, and so forth.

. . .

Video signal row of primary color 4: video signal row made up of video signals D41, D42, D43, and so forth.

It is noted that the primary colors 1, 2, 3, and 4 are allocated in this order to the respective pixels on the image display panel.

In the formula above, t is a natural number not less than S. Therefore, after determining to which one of the output terminals r(S), g(S), and b(S) the video signal D11 is supplied, the values rx, ry, gx, gy, bx, and by are worked out by substituting integers in ascending order for t, in such a manner as t=S, S+1, S+2, and so forth. As a result, the video signals R(t), G(t), and B(t) are calculated as below.

(1) Provided that the video signal D11 corresponds to the output terminal r(S), A=0, and hence:

R(t): video signals D11, D41, D32, and so forth;

G(t): video signals D21, D12, D42, and so forth; and

B(t): video signals D31, D22, D13, and so forth, therefore,

First type: video signals D11, D41, D32, and so forth;

Second type: video signals D21, D12, D42, and so forth; and

Third type: video signals D31, D22, D13, and so forth.

(2) Provided that the video signal D11 corresponds to the output terminal g(S), A=−1, and hence:

First type: video signals ---, D31, D22, and so forth;

Second type: video signals D11, D41, D32, and so forth; and

Third type: video signals D21, D12, D42, and so forth.

It is noted that "---" indicates that there is no corresponding J-primary-color video signal.

(3) Provided that the video signal D11 corresponds to the output terminal b(S), A=−2, and hence:

First type: video signals ---, D21, D12, and so forth;

Second type: video signals ---, D31, D22, and so forth; and

Third type: video signals D11, D41, D32, and so forth.

It is noted that "---" indicates that there is no corresponding video signal of one of J primary colors.

As the video signal rows of three types being thus converted show, the video signal rows of four types are converted into the video signal rows of three types, in the order corresponding to the order of four primary colors on the image display panel.

On this account, the video signal rows of three types supplied from the video signal processing circuit of the present invention are serially outputted from the source driver having three input/output types, so that the video signals are outputted in the order corresponding to the order of four primary colors on the image display panel. Therefore, the video signal processing circuit of the present invention allows for image reproduction with four primary colors, using a source driver having three input/output types.

In particular, in the present invention, the video signal rows of three types are generated in accordance with a predetermined formula. This makes it possible to easily convert video signal rows of J types into video signal rows of three types. For this reason, the manufacturing costs of the image display device are reduced by adopting a general-use source driver, and also processes performed in the video signal processing circuit are simplified.

As a matter of course, the video signal processing circuit described above can adopt the aforesaid conversion of the video signal rows of J types to video signal rows of (J−1) types, in order to support an image display panel on which two of J primary colors are alternately provided between the groups.

That is, a video signal processing circuit of the present invention may be arranged in such a manner that, the video signal rows of J types are converted into video signal rows of (J−1) types, by (i) extracting video signals from two video signal rows that are arbitrarily selected from the video signal rows of J types, while alternately selecting the two video signal rows from which the video signals are extracted, and (ii) generating one video signal row by aligning the extracted video signals in line with time series, and the video signal rows of (J−1) types are rearranged to the video signal rows of three types, in accordance with a formula:

$$R(t)=Drxry$$

$$G(t)=Dgxgy$$

$$B(t)=Dbxby,$$

where:

$$rx=\{3(t-S)+A+1\}-(J-1)\cdot Int[\{3(t-S)+A\}/(J-1)]$$

$$ry=Int[\{3(t-S)+A\}/(J-1)]+1$$

$$gx=\{3(t-S)+A+2\}-(J-1)\cdot Int[\{3(t-S)+A+1\}/(J-1)]$$

$$gy=Int[\{3(t-S)+A+1\}/(J-1)]+1$$

$$bx=\{3(t-S)+A+3\}-(J-1)\cdot Int[\{3(t-S)+A+2\}/(J-1)]$$

$$by=Int[\{3(t-S)+A+2\}/(J-1)]+1, \text{ and}$$

(1) If the video signal D11 is supplied to the output terminal r(S), A=0

(2) If the video signal D11 is supplied to the output terminal g(S), A=−1

(3) If the video signal D11 is supplied to the output terminal b(S), A=−2, (I) Dmn represents video signals included in the video signal rows of (J−1) types, (II) m is an integer in a range between 1 and J−1, (III) n is an integer indicating to what number pixel of each primary color a video signal is supplied, (IV) R(t), G(t), and B(t) represent video signals in the video signal rows of three types, (V) t is an integer indicating an order of a video signal in an associated video signal row, (VI) r(1), g(1), b(1) represent output terminals of three types in a source driver (VII) 1 is an integer indicating an order of an output terminal in an associated type), (VIII) a video signal D11 among the video signals of (J−1) types is supplied to one of an output terminal r(S), an output terminal g(S), and an output terminal b(S), (IX) To Int[ ], a value in a bracket, from which figures after the decimal point are omitted, is entered, and (X) S is a number in one of brackets in output terminals r( ), g( ), and b( ) corresponding to the video signal D11, in a case where classification into (1)-(3) is carried out.

Alternatively, a video signal processing circuit of the present invention may be arranged in such a manner that, in regard to two video signal rows arbitrarily selected from the video signal rows of J types, video signals whose orders in the respective two video signal rows are identical are synthesized, one video signal row is generated by aligning the synthesized video signals in line with time series, and consequently the video signal rows of J types are converted into video signal rows of (J−1) types, and the video signal rows of (J−1) types are rearranged to the video signal rows of three types, in accordance with a formula:

$$R(t)=Drxry$$

$$G(t)=Dgxgy$$

$$B(t)=Dbxby,$$

where:

$$rx=\{3(t-S)+A+1\}-(J-1)\cdot Int[\{3(t-S)+A\}/(J-1)]$$

$$ry=Int[\{3(t-S)+A\}/(J-1)]+1$$

$$gx=\{3(t-S)+A+2\}-(J-1)\cdot Int[\{3(t-S)+A+1\}/(J-1)]$$

$$gy=Int[\{3(t-S)+A+1\}/(J-1)]+1$$

$$bx=\{3(t-S)+A+3\}-(J-1)\cdot Int[\{3(t-S)+A+2\}/(J-1)]$$

$$by=Int[\{3(t-S)+A+2\}/(J-1)]+1, \text{ and}$$

(1) If the video signal D11 is supplied to the output terminal r(S), A=0

(2) If the video signal D11 is supplied to the output terminal g(S), A=−1

(3) If the video signal D11 is supplied to the output terminal b(S), A=−2, (i) Dmn represents video signals included in the video signal rows of (J−1) types, (ii) m is an integer in a range between 1 and J−1, (iii) n is an integer indicating to what number pixel of each primary color a video signal is supplied, (iv) R(t), G(t), and B(t) represent the video signals in the video signal rows of three types, (v) t is an integer indicating an order of a video signal in an associated video signal row, (vi) r(1), g(1), b(1) represent output terminals of three types in a source driver, (vii) 1 is an integer indicating an order of an output terminal in an associated type, (viii) a video signal D11 among the video signals of (J−1) types is supplied to one of an output terminal r(S), an output terminal g(S), and an output terminal b(S), (ix) to Int[ ], a value in a bracket, from which figures after the decimal point are omitted, is entered, and (x), S is a number in one of brackets in output terminals r( ), g( ), and b( ) corresponding to the video signal D11, in a case where classification into (1)-(3) is carried out.

It is noted that, by a video signal processing program that causes a computer to execute the steps in the aforesaid video signal processing method, it is possible to obtain, by means of the computer, the effects similar to those of the video signal processing method of the present invention. Furthermore, the video signal processing program can be run on any computer, by storing the program in a computer-readable storage medium.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A video signal processing circuit that converts video signals supplied to pixels disposed in a matrix manner on an image display panel, wherein, with regard to each of J (J is an integer not less than four) primary colors for image display on the image display panel, (i) three video signals are extracted from each of video signal rows of J types in which the video signals are aligned in line with time series, in such a manner as to cause an order of primary colors reproduced by the three video signals to be in line with an order of the J primary colors allocated to the respective pixels, and (ii) video signal rows of three types are generated by serially allocating each of the three video signals to any one of the video signal rows of three types.

2. The video signal processing circuit as defined in claim 1, wherein, the video signal rows of J types are rearranged to the video signal rows of three types, in accordance with a formula:

$$R(t)=Drxry$$

$$G(t)=Dgxgy$$

$$B(t)=Dbxby,$$

where:

$$rx=\{3(t-1)+1\}-J\cdot Int[\{3(t-1)\}/J]$$

$$ry=Int[\{3(t-1)\}/J]+1$$

$$gx=\{3(t-1)+2\}\cdot J\cdot Int[\{3(t-1)+1\}/J]$$

$$gy=Int[\{3(t-1)+1\}/J]+1$$

$$bx=\{3(t-1)+3\}-J\cdot Int[\{3(t-1)+2\}/J]$$

$$by=Int[\{3(t-1)+2\}/J]+1,$$

(i) Dmn represents the video signals included in the video signal rows of J types, (ii) m is an integer in a range between 1 and J, (iii) n is an integer indicating to what number pixel of each primary color a video signal is supplied, (iv) R(t), G(t), and B(t) represent video signals included in the video signal rows of three types, (v) t is an integer indicating an order of a video signal in an associated video signal row, and (vi) to Int[ ], a value in a bracket, from which figures after the decimal point are omitted, is entered.

3. The video signal processing circuit as defined in claim 1, wherein, the video signal rows of J types are converted into video signal rows of (J−1) types, by (i) extracting video signals from two video signal rows that are arbitrarily selected from the video signal rows of J types, while alternately selecting the two video signal rows from which the video signals are extracted, and (ii) generating one video signal row by aligning the extracted video signals in line with time series, and the video signal rows of (J−1) types are rearranged to the video signal rows of three types, in accordance with a formula:

$$R(t)=Drxry$$

$$G(t)=Dgxgy$$

$$B(t)=Dbxby,$$

where:

$$rx=\{3(t-1)+1\}-(J-1)\cdot Int[\{3(t-1)\}/(J-1)]$$

$$ry=Int[\{3(t-1)\}/(J-1)]+1$$

$$gx=\{3(t-1)+2\}-(J-1)\cdot Int[\{3(t-1)+1\}/(J-1)]$$

$$gy=Int[\{3(t-1)+1\}/(J-1)]+1$$

$$bx=\{3(t-1)+3\}-(J-1)\cdot Int[\{3(t-1)+2\}/(J-1)]$$

$$by=Int[\{3(t-1)+2\}/(J-1)]+1,$$

(I) Dmn represents the video signals included in the video signal rows of (J−1) types, (II) m is an integer in a range between 1 and J−1, (III) n is an integer indicating to what number pixel of each primary color a video signal is supplied, (IV) R(t), G(t), and B(t) represent video signals in the video signal rows of three types, (V) t is an integer indicating an order of a video signal in an associated video signal row, and (VI) to Int[ ], a value in a bracket, from which figures after the decimal point are omitted, is entered.

4. The video signal processing circuit as defined in claim 1, wherein, in regard to two video signal rows arbitrarily selected from the video signal rows of J types, video signals whose orders in the respective two video signal rows are identical are synthesized, one video signal row is generated by aligning the synthesized video signals in line with time series, and consequently the video signal rows of J types are converted into video signal rows of (J−1) types, and the video signal rows of (J−1) types are rearranged to the video signal rows of three types, in accordance with a formula:

$$R(t)=Drxry$$

$$G(t)=Dgxgy$$

$$B(t)=Dbxby,$$

where:

$$rx=\{3(t-1)+1\}-(J-1)\cdot Int[\{3(t-1)\}/(J-1)]$$

$$ry=Int[\{3(t-1)\}/(J-1)]+1$$

$$gx=\{3(t-1)+2\}-(J-1)\cdot Int[\{3(t-1)+1\}/(J-1)]$$

$$gy=Int[\{3(t-1)+1\}/(J-1)]+1$$

$$bx=\{3(t-1)+3\}-(J-1)\cdot Int[\{3(t-1)+2\}/(J-1)]$$

$$by=Int[\{3(t-1)+2\}/(J-1)]+1,$$

(i) Dmn represents the video signals included in the video signal rows of (J−1) types, (ii) m is an integer in a range between 1 and J−1, (iii) n is an integer indicating to what number pixel of each primary color a video signal is supplied, (iv) R(t), G(t), and B(t) represent video signals in the video signal rows of three types, (v) t is an integer indicating an order of a video signal in an associated video signal row, and (vi) to Int[ ], a value in a bracket, from which figures after the decimal point are omitted, is entered.

5. The video signal processing circuit as defined in claim 1, wherein, the video signal rows of J types are rearranged to the video signal rows of three types, in accordance with a formula:

$$R(t)=Drxry$$

$$G(t)=Dgxgy$$

$$B(t)=Dbxby,$$

where:

$$rx=\{3(t-S)+A+1\}-J\cdot \mathrm{Int}[\{3(t-S)+A\}/JJ$$

$$ry=Int[\{3(t-S)+A\}/JJ]+1$$

$$gx=\{3(t-S)+A+2\}-J\cdot Int[\{3(t-S)+A+1\}/JJ$$

$$gy=Int[\{3(t-S)+A+1\}/JJ]+1$$

$$bx=\{3(t-S)+A+3\}-J\cdot Int[\{3(t-S)+A+2\}/JJ$$

$$by=Int[\{3(t-S)+A+2\}/JJ]+1, \text{ and}$$

(1) If the video signal D11 is supplied to the output terminal r(S), A=0

(2) If the video signal D11 is supplied to the output terminal g(S), A=−1

(3) If the video signal D11 is supplied to the output terminal b(S), A=−2, (i) Dmn represents the video signals included in the video signal rows of J types, (ii) m is an integer in a range between 1 and J, (iii) n is an integer indicating to what number pixel of each primary color a video signal is supplied, (iv) R(t), G(t), and B(t) represent video signals included in the video signal rows of three types, (v) t is an integer indicating an order of a video signal in an associated video signal row, (vi) r(1), g(1), b(1) represent output terminals of three types in a source driver, (vii) 1 is an integer indicating an order of an output terminal in an associated type, (viii) a video signal D11 among the video signals of J types is supplied to one of an output terminal r(S), an output terminal g(S), and an output terminal b(S), (ix) to Int[ ], a value in a bracket, from which figures after the decimal point are omitted, is entered, and (x) S is a number in one of brackets in output terminals r( ), g( ), and b( ) corresponding to the video signal D11, in a case where classification into (1)-(3) is carried out.

6. The video signal processing circuit as defined in claim 1, wherein, the video signal rows of J types are converted into video signal rows of (J−1) types, by (i) extracting video signals from two video signal rows that are arbitrarily selected from the video signal rows of J types, while alternately selecting the two video signal rows from which the video signals are extracted, and (ii) generating one video signal row by aligning the extracted video signals in line with time series, and the video signal rows of (J−1) types are rearranged to the video signal rows of three types, in accordance with a formula:

$$R(t)=Drxry$$

$$\mathrm{P}\ G(t)=Dgxgy$$

$$B(t)=Dbxby,$$

where:

$$rx=\{3(t-S)+A+1\}-(J-1)\cdot Int[\{3(t-S)+A\}/(J-1)]$$

$$ry=Int[\{3(-S)+A\}/(J-1)]+1$$

$$gx=\{3(t-S)+A+2\}-(J-1)\cdot Int[\{3(t-S)+A+1\}/(J-1)]$$

$$gy=Int[\{3(t-S)+A+1\}/(J-1)]+1$$

$$bx=\{3(t-S)+A+3\}-(J-1)\cdot Int[\{3(t-S)+A+2\}/(J-1)]$$

$$by=Int[\{3(t-S)+A+2\}/(J-1)]+1, \text{ and}$$

(1) If the video signal D11 is supplied to the output terminal r(S), A=0

(2) If the video signal D11 is supplied to the output terminal g(S), A=−1

(3) If the video signal D11 is supplied to the output terminal b(S), A=−2, (I) Dmn represents video signals included in the video signal rows of (J−1) types, (II) m is an integer in a range between 1 and J−1, (III) n is an integer indicating to what number pixel of each primary color a video signal is supplied, (IV) R(t), G(t), and B(t) represent video signals in the video signal rows of three types, (V) t is an integer indicating an order of a video signal in an associated video signal row, (VI) r(1), g(1), b(1) represent output terminals of three types in a source driver (VII) 1 is an integer indicating an order of an output terminal in an associated type), (VIII) a video signal D11 among the video signals of (J−1) types is supplied to one of an output terminal r(S), an output terminal g(S), and an output terminal b(S), (IX) To Int[ ], a value in a bracket, from which figures after the decimal point are omitted, is entered, and (X) S is a number in one of brackets in output terminals r( ), g( ), and b( ) corresponding to the video signal D11, in a case where classification into (1)-(3) is carried out.

7. The video signal processing circuit as defined in claim 1, wherein, in regard to two video signal rows arbitrarily selected from the video signal rows of J types, video signals whose orders in the respective two video signal rows are identical are synthesized, one video signal row is generated by aligning the synthesized video signals in line with time series, and consequently the video signal rows of J types are converted into video signal rows of (J−1) types, and the video signal rows of (J−1) types are rearranged to the video signal rows of three types, in accordance with a formula:

$$R(t)=Drxry$$

$$G(t)=Dgxgy$$

$$B(t)=Dbxby,$$

where:

$$rx=\{3(t-S)+A+1\}-(J-1)\cdot Int[\{3(-S)+A\}/(J-1)]$$

$$ry=Int[\{3(-S)+A\}/(J-1)]+1$$

$$gx=\{3(t-S)+A+2\}-(J-1)\cdot Int[\{3(t-S)+A+1\}/(J-1)]$$

$$gy=Int[\{3(t-S)+A+1\}/(J-1)]+1$$

$$bx=\{3(t-S)+A+3\}-(J-1)\cdot Int[\{3(t-S)+A+2\}/(J-1)]$$

$$by=Int[\{3(t-S)+A+2\}/(J-1)]+1, \text{ and}$$

(1) If the video signal D11 is supplied to the output terminal r(S), A=0

(2) If the video signal D11 is supplied to the output terminal g(S), A=−1

(3) If the video signal D11 is supplied to the output terminal b(S), A=−2, (i) Dmn represents video signals included in the video signal rows of (J−1) types, (ii) m is an integer in a range between 1 and J−1, (iii) n is an integer indicating to what number pixel of each primary color a video signal is supplied, (iv) R(t), G(t), and B(t) represent the video signals in the video signal rows of three types, (v) t is an integer indicating an order of a video signal in an associated video signal row, (vi) r(1), g(1), b(1) represent output terminals of three types in a source driver, (vii) 1 is an integer indicating an order of an output terminal in an associated type, (viii) a video signal D11 among the video signals of (J−1) types is supplied to one of an output terminal r(S), an output terminal g(S), and an output terminal b(S), (ix) to Int[ ], a value in a bracket, from which figures after the decimal point are omitted, is entered, and (x), S is a number in one of brackets in output terminals r( ), g( ), and b( ) corresponding to the video signal D11, in a case where classification into (1)-(3) is carried out.

8. A video signal processing method by which video signals supplied to pixels provided in a matrix manner on an image display panel are converted, the video signal processing method comprising the steps of:

(i) with regard to each of J (J is an integer not less than four) primary colors for image display on the image display panel, extracting three video signals from each of video signal rows of J types in which the video signals are aligned in line with time series, in such a manner as to cause an order of primary colors reproduced by the three video signals to be in line with an order of the J primary colors allocated to the respective pixels, and (ii) generating video signal rows of three types by serially allocating each of the three video signals to any one of the video signal rows of three types.

9. A computer-readable storage medium storing A video signal processing program, causing a computer to execute the steps of the video signal processing method defined in claim 8.

* * * * *